US010479077B2

(12) United States Patent
Ishizaki

(10) Patent No.: US 10,479,077 B2
(45) Date of Patent: Nov. 19, 2019

(54) HEAD MODULE AND LIQUID JETTING APPARATUS INCLUDING THE SAME

(71) Applicant: BROTHER KOGYO KABUSHIKI KAISHA, Nagoya-shi, Aichi-ken (JP)

(72) Inventor: Hirotoshi Ishizaki, Nagakute (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/014,381

(22) Filed: Jun. 21, 2018

(65) Prior Publication Data

US 2018/0311958 A1 Nov. 1, 2018

Related U.S. Application Data

(63) Continuation of application No. 15/649,801, filed on Jul. 14, 2017, now Pat. No. 10,022,964.

(30) Foreign Application Priority Data

Jul. 22, 2016 (JP) ..... 2016-144462

(51) Int. Cl.
*B41J 2/14* (2006.01)
*B41J 2/045* (2006.01)
*B41J 29/377* (2006.01)

(52) U.S. Cl.
CPC ..... *B41J 2/14201* (2013.01); *B41J 2/04515* (2013.01); *B41J 29/377* (2013.01); *B41J 2002/14362* (2013.01); *B41J 2002/14419* (2013.01); *B41J 2002/14459* (2013.01); *B41J 2202/08* (2013.01); *B41J 2202/20* (2013.01); *B41J 2202/21* (2013.01)

(58) Field of Classification Search
CPC .. B41J 29/377; B41J 2/04515; B41J 2202/08; B41J 2/1408
See application file for complete search history.

(56) References Cited

U.S. PATENT DOCUMENTS

2004/0227788 A1 11/2004 Katayama
2006/0152541 A1 7/2006 Isozaki et al.
2017/0173946 A1 6/2017 Yamanaka et al.

FOREIGN PATENT DOCUMENTS

JP 2013-159105 A 8/2013

*Primary Examiner* — Julian D Huffman
(74) *Attorney, Agent, or Firm* — Merchant & Gould P.C.

(57) ABSTRACT

There is provided a head module including: a head which has an inlet, a plurality of nozzles, and a plurality of driving elements, and in which the nozzles are aligned in rows in a longitudinal direction of a nozzle surface orthogonal to a attaching/detaching direction of the head module; a plurality of driver ICs; a heat spreader; a flexible substrate; and a rigid substrate. In the attaching/detaching direction, the driver ICs are arranged between the head and the heat spreader; the rigid substrate and the head are arranged side by side in the attaching/detaching direction; the rigid substrate and the heat spreader are arranged side by side in a short direction of the nozzle surface; and the rigid substrate has a thickness along the short direction of the nozzle surface.

10 Claims, 19 Drawing Sheets

HEAD MODULE AND LIQUID JETTING APPARATUS INCLUDING THE SAME

CROSS REFERENCE TO RELATED APPLICATION

The present application is a Continuation of U.S. patent application Ser. No. 15/649,801 filed on Jul. 14, 2017, which claims priority from Japanese Patent Application No. 2016-144462 filed on Jul. 22, 2016 the disclosure of which is incorporated herein by reference in its entirety.

BACKGROUND

Field of the Invention

The present invention relates to a head module constructing a liquid jetting apparatus, and to a liquid jetting apparatus provided with the head module.

Description of the Related Art

Conventionally, there is known a head module provided with a recording head which jets (discharges) an ink from nozzles formed in a lower surface (hereinafter referred to as a "nozzle surface") of the recording head, two driving ICs, a circuit board (wiring board) having the two driving ICs, a heat sink and a carriage substrate. In this conventional head module, the two driving ICs arranged side by side in a one horizontal direction are located to be above the recording head. Further, the heat sink extending across or over the two driving ICs is located to be above the two driving ICs. Furthermore, the carriage substrate is located to be above the heat sink. The carriage substrate overlaps with the heat sink in the up-down direction. Note that the heat sink radiates any heat generated in the driving ICs. Moreover, the carriage substrate is connected to the circuit board.

Here, in the conventional head module, the carriage substrate is located to be above the heat sink, and further the heat sink is overlapped with the carriage substrate in the up-down direction. Therefore, there is such a fear that the carriage substrate might hinder or inhibit the radiation of the heat by the heat sink.

An object of the present disclosure is to provide a head module and a liquid jetting apparatus wherein the substrate is arranged so as not to prevent the heat radiation by a heat spreader (heat radiator).

SUMMARY

According to an aspect of the present disclosure, there is provided a head module configured to be removably attached to a liquid jetting apparatus along an attaching direction, including:

a head having:

an inlet;

a plurality of nozzles configured to jet a liquid inflowed thereto via the inlet; and a plurality of driving elements configured to impart a jetting energy to the liquid in the plurality of nozzles, respectively, the plurality of nozzles being aligned in a row in a longitudinal direction of a nozzle surface which is orthogonal to the attaching direction;

a plurality of driver ICs configured to drive the plurality of driving elements;

a heat spreader thermally making contact with the plurality of driver ICs;

a flexible substrate connected to the plurality of driver ICs; and a rigid substrate connected to the flexible substrate and having rigidity higher than that of the flexible substrate, wherein in the attaching direction, the plurality of driver ICs are arranged between the head and the heat spreader;

the rigid substrate and the head are arranged side by side in the attaching direction;

the rigid substrate and the heat spreader are arranged side by side in a short direction of the nozzle surface; and the rigid substrate has a thickness along the short direction of the nozzle surface.

Further, according to another aspect of the present disclosure, there is provided a head module configured to be removably attached to a liquid jetting apparatus along an attaching direction, comprising:

a head having:

an inlet;

a plurality of nozzles configured to jet a liquid inflowed thereto via the inlet; and a plurality of driving elements configured to impart a jetting energy to the liquid in the plurality of nozzles, respectively, the plurality of nozzles being aligned in a row in a first direction parallel to a nozzle surface which is orthogonal to the attaching direction;

a driver IC configured to drive the plurality of driving elements;

a heat spreader thermally making contact with the driver IC;

a flexible substrate connected to the driver IC; and a rigid substrate connected to the flexible substrate and having rigidity higher than that of the flexible substrate, wherein in the attaching direction, the driver IC is arranged between the head and the heat spreader;

the rigid substrate and the head are arranged side by side in the attaching direction;

the rigid substrate and the heat spreader are arranged side by side in a second direction which is parallel to the nozzle surface and which crosses the first direction; and the rigid substrate has a thickness along the second direction.

According to the present disclosure, the rigid substrate and the heat spreader are arranged side by side in the short direction of the nozzle surface (second direction), and the thickness of the rigid substrate is along the short direction of the nozzle surface (second direction). With this, the overlapping of the rigid substrate and the heat spreader in the attaching direction is made to be small as much as possible (this configuration also encompasses such a configuration wherein the rigid substrate and the heat spreader do not overlap with each other at all in the attaching direction), thereby making it possible to prevent the heat radiation by the heat spreader from being hindered by the rigid substrate. Further, this configuration is capable of preventing or restraining the size of the head module, in the alignment direction of the nozzles (the longitudinal direction of the nozzle surface, first direction as described above), from becoming large, than in a case wherein the rigid substrate and the heat spreader are arranged side by side in the longitudinal direction of the nozzle surface (first direction).

BRIEF DESCRIPTION OF THE DRAWINGS

FIG. 6A is a view of the head module as seen from the upper side, wherein

FIG. 12A is a view of the case as seen from the upper side, wherein

DESCRIPTION OF THE EMBODIMENTS

In the following, an explanation will be given about an embodiment of the present disclosure.

<Overall Configuration of Printing Apparatus>

Figure 1:
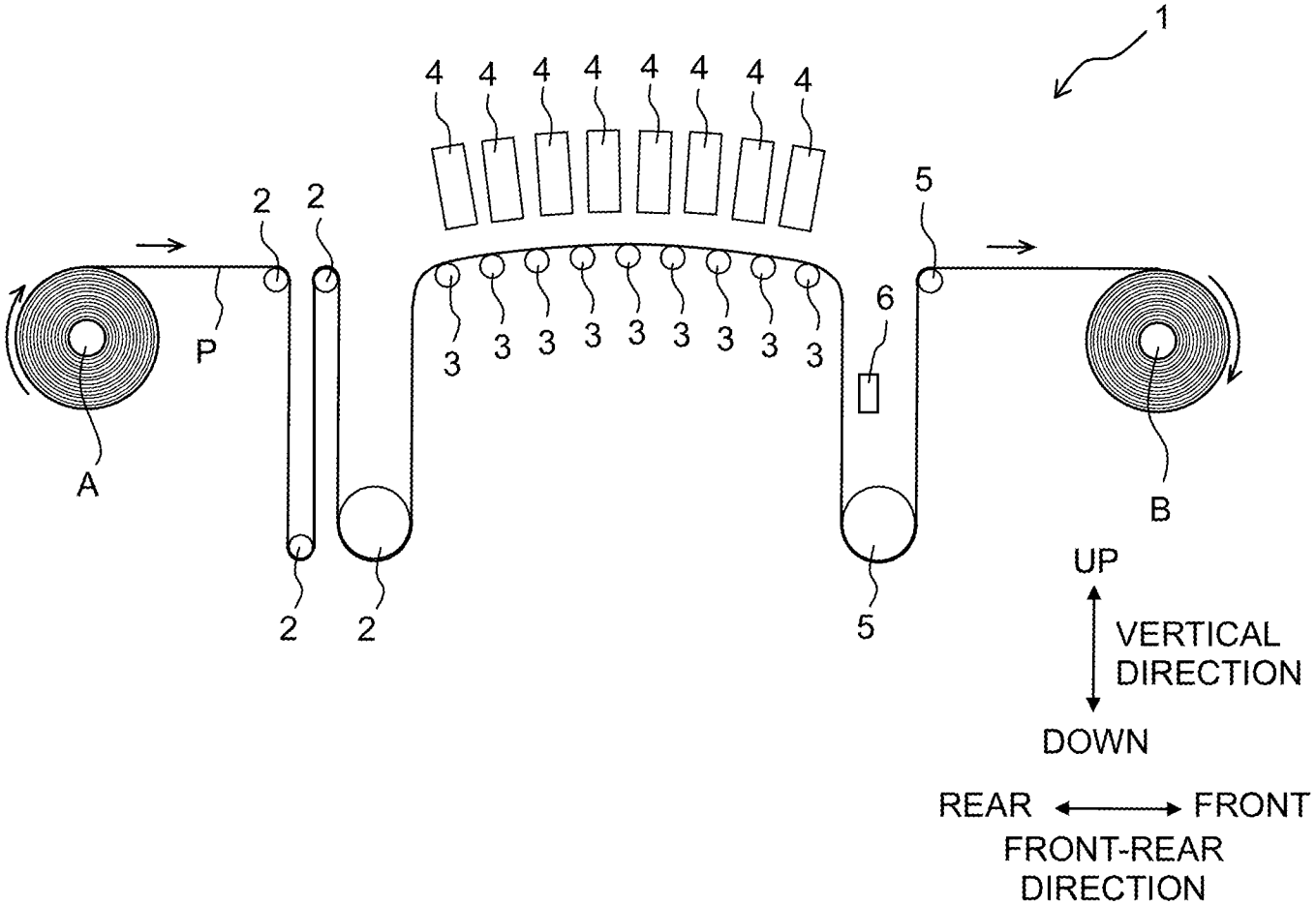
FIG. 1 is a view schematically depicting the configuration of a printing apparatus.

As depicted in FIG. 1, a printing apparatus 1 as a liquid jetting apparatus has a plurality of upstream rollers 2, nine pieces of supporting roller 3, eight pieces of line head 4, a plurality of downstream rollers 5, and a UV irradiating device 6. In the front-rear direction, the plurality of supporting rollers 3 and the eight line heads 4 are located in front of the plurality of upstream rollers 2, and the plurality of downstream rollers 5 are located in front of the plurality of supporting rollers 3 and the eight line heads 4.

The plurality of upstream rollers 2 convey a rolled paper P wound around a circular tube A. The plurality of upstream rollers 2 are apart from each other in the front-rear direction, and are apart from each other in the vertical direction. The rolled paper P is conveyed in a forward direction while being bent by the plurality of upstream rollers 2. The nine supporting rollers 3 are located in front of the plurality of upstream rollers 2 in the front-rear direction, and are arranged side by side in the front-rear direction. The nine supporting roller 3 conveys the rolled paper P, conveyed from the plurality of upstream rollers 2, in the frontward direction, while supporting the rolled paper P from therebelow.

Figure 4:
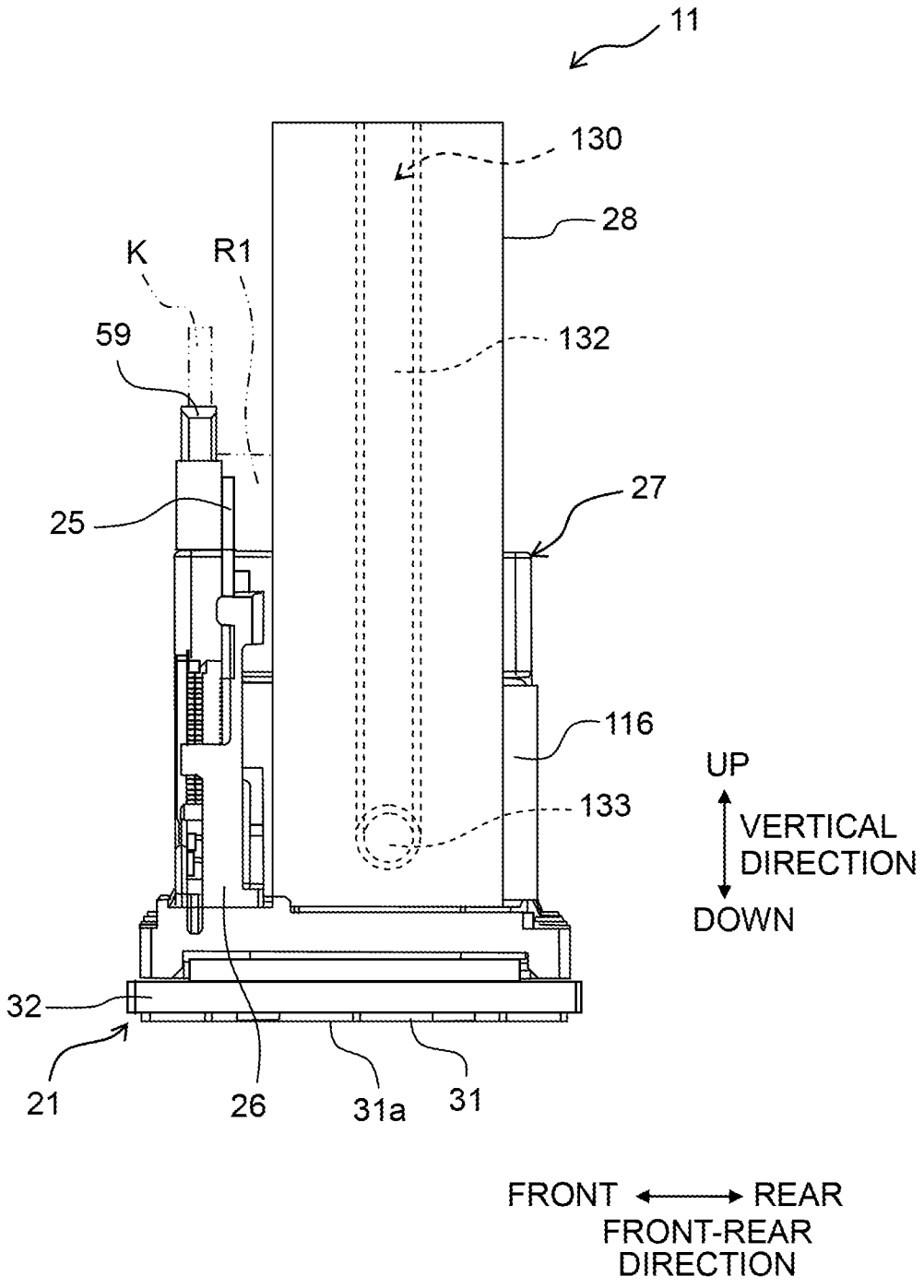
FIG. 4 is a view of the head module as seen from the right side.

The eight line heads 4 are located at a position above or over the nine supporting rollers 3, and are arranged side by side along the conveyance direction. Further, in the front-rear direction, the line heads 4 are arranged such that each one of the eight line heads 4 is located between two adjacent supporting rollers 3 among the nine supporting rollers 3. Each of the line heads 4 jets or discharges an ink from a plurality of nozzle 10 (see FIG. 2) formed in a nozzle surface 31*a* (see FIG. 4) which is the lower surface of the line head 4. With this, the ink lands on the rolled paper P conveyed by the supporting rollers 3, and an image, etc., is printed on the rolled paper P by the landed ink. Here, among the eight line heads 4, six line heads 4 on the front side jet black, yellow, cyan, magenta, orange and purple inks, respectively. Note that regarding the six line heads 4 on the front side, each of the six line heads jets one color ink. Regarding the eight line heads 4, two line heads 4 on the rear side jet white ink. Namely, the two line heads 4 on the rear side both jet one color ink that is the white ink. Further, the ink jetted from each of the line heads 4 is a UV ink which is curable by being irradiated with a ultraviolet ray. Furthermore, the white ink contains titanium oxide as a coloring material thereof.

The plurality of downstream rollers 5 are arranged in front of the nine supporting roller 3. The plurality of downstream rollers 5 convey the rolled paper P conveyed from the nine supporting rollers 3. The plurality of downstream rollers 5 are apart from each other in the front-rear direction, and are apart from each other in the vertical direction. The rolled paper P is conveyed in a forward direction while being bent by the plurality of downstream rollers 5. Further, the rolled paper P conveyed by the plurality of downstream rollers 5 is wound around by a circular tube B. The UV irradiating device 6 is located at an intermediate portion of a conveyance path or route of the rolled paper P conveyed by the plurality of downstream rollers 5, and irradiates the ultraviolet ray onto a print surface of the rolled paper P, thereby curing the UV ink on the rolled paper P.

Namely, provided that the direction in which the rolled paper P wound around the circular tube A is conveyed to the circular tube B is the conveyance direction, the circular tube A, the plurality of upstream rollers 2, the nine supporting rollers 3 (or the eight line heads 4), the UV irradiating device 6, the plurality of downstream rollers 5, and the circular tube B are arranged in this order from the upstream side toward the downstream side of the conveyance direction. Further, in the conveyance direction, the six line heads 4 which jet the black, yellow, cyan, magenta, orange, purple inks, respectively, are located on the downstream side of the two line heads 4 both of which jet the white ink. Furthermore, the eight line heads 4 face the surface of the rolled paper P which is being conveyed. Moreover, the eight supporting rollers 3 face and make contact with the rear (back) surface of the rolled paper P which is being conveyed.

<Line Head>

Figure 2:
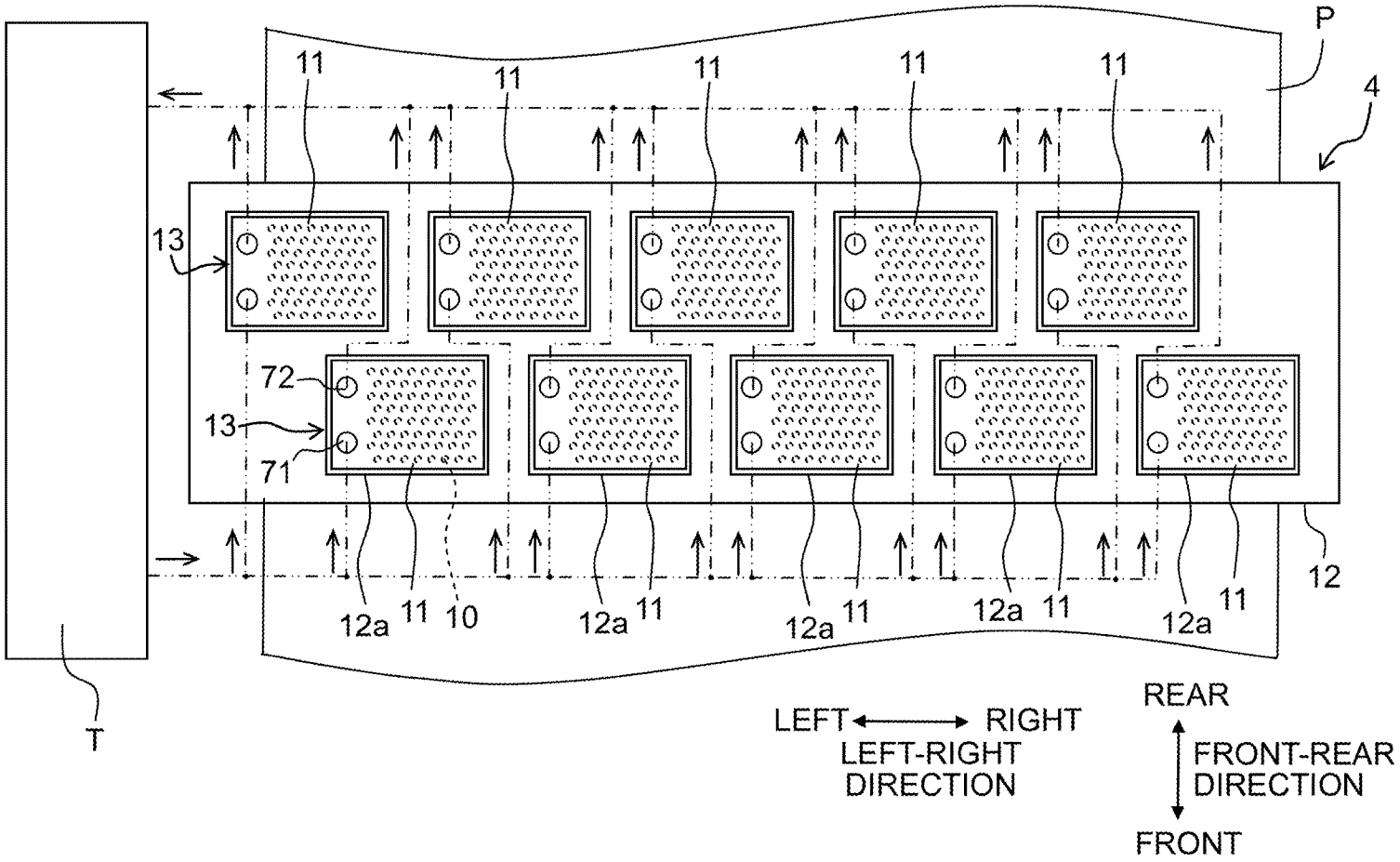
FIG. 2 is a view schematically depicting the configuration of a line head.

Next, an explanation will be given about the eight line heads 4. The eight line heads 4 have a same structure. Namely, in the following description, one of the line heads 4 will be explained. As depicted in FIG. 2, each of the line heads 4 is provided with ten pieces of head module 11, and a module holder 12. Note that in the following explanation, a direction orthogonal to the front-rear direction and the vertical direction is referred to as the left-right direction (an example of a "first direction"). Further, in the following explanation, the rightward and the leftward in the left-right direction are the right side and the left side as seen from the front side. Furthermore, since the ten head modules 11 have a same structure, one of the head modules 11 will be explained in the following description.

Each of the head modules 11 has a plurality of nozzles 10, and jets an ink from the plurality of nozzles 10, as described above. Further, the module 11 has an inflow port 71 and an outflow port 72 (which will be described later on) on a left end portion thereof. In the head module 11, the inflow port 71 and the outflow port 72 are communicated with an ink tank T by non-illustrated tubes, etc. With this, the ink supplied from the ink tank T inflows into the head module 11 from the inflow port 71. Furthermore, the ink inside the head module 11 outflows from the outflow port 72 and returns to the ink tank T. Namely, the ink circulates between the head module 11 and the ink tank T. An ink flow channel (ink channel) inside the head module 11 will be specifically explained later on. Note that although the ink tank T is depicted on the left side of the line head 4 for the sake of convenience, the position of the ink tank T may be another position, such as a position on the upper side of the line head 4, for example.

Further, five head modules 11 among the ten head modules 11 are arranged side by side in the left-right direction. A row formed by the five head modules arranged side by side in the left-right direction is referred to as a module row 13. One line head 4 has two module rows 13 arranged side by side in the front-rear direction. Further, among the two module rows 13, a module row 13 on the front side is shifted in the rightward direction with respect to another module row 13 on the rear side. With this, the ten head modules 11 are aligned or arranged in the entire length in the left-right direction of the rolled paper P. Namely, the ten head modules 11 are arranged in the staggered manner with respect to one another in the left-right and front-rear directions. Module holder 12 extends in the left-right direction over the entire width of the rolled paper P. The module holder 12 has a plurality of accommodating sections 12*a* in which the head modules 11 are accommodated, respectively. The head modules 11 are installed in or attached to the module holder 12 by being inserted into the accommodating sections 12*a*, respectively, from therebelow. Namely, in the present embodiment, the vertical direction is an attaching/detaching direction in which the head modules 11 are attached/detached with respect to the printing apparatus 1. Further, the plurality of head modules 11 are accommodated in the accommodating sections 12*a*, respectively, thereby allowing the plurality of head modules 11 to be held (maintained) in the above-described positional relationship by the module holder 12.

<Head Module>

Next, the configuration of the head modules 11 will be explained, with reference to the drawings. As depicted in FIGS. 3 to 7 (see, in particular, FIGS. 3 and 7), each of the head modules 11 is provided with a head 21, a COF substrate 22, a heat spreader (heat radiator) 23, a flexible substrate 24, a rigid substrate 25, a substrate holder 26, a case 27 and a cooler 28.

<Head>

Figure 7:
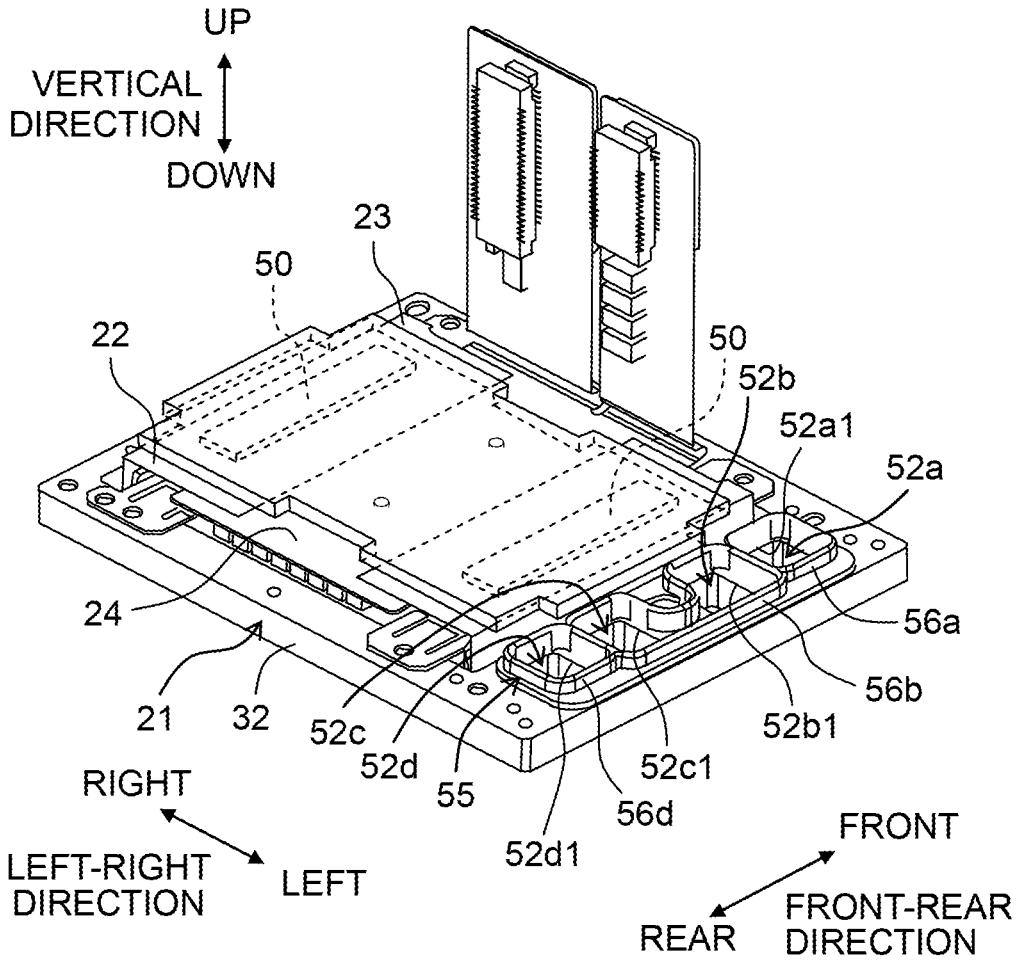
FIG. 7 is a perspective view of a head, a COF substrate, a sealing member and a flexible substrate.
Figure 8:
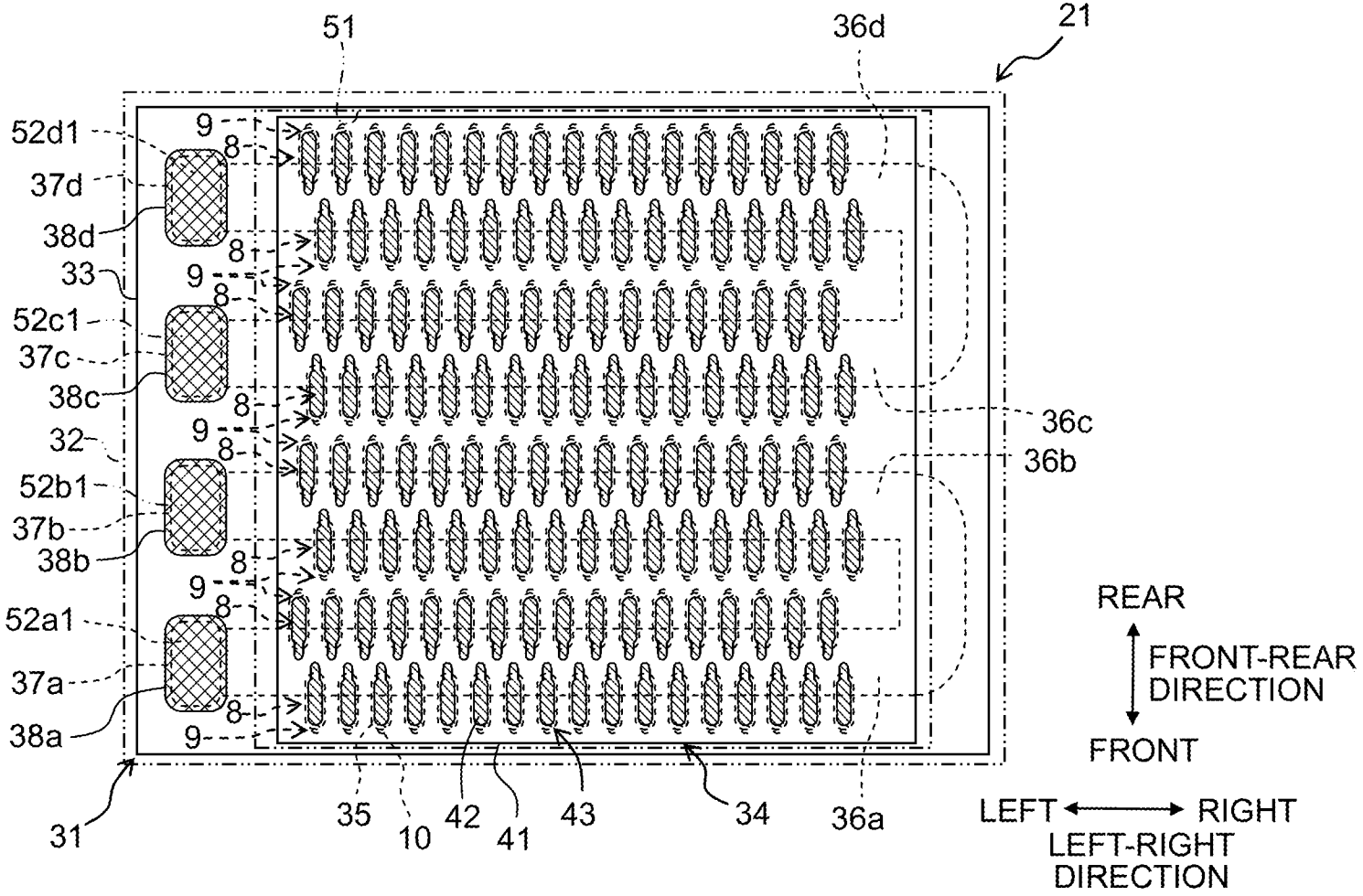
FIG. 8 is a plane view of a head chip.
Figure 9:
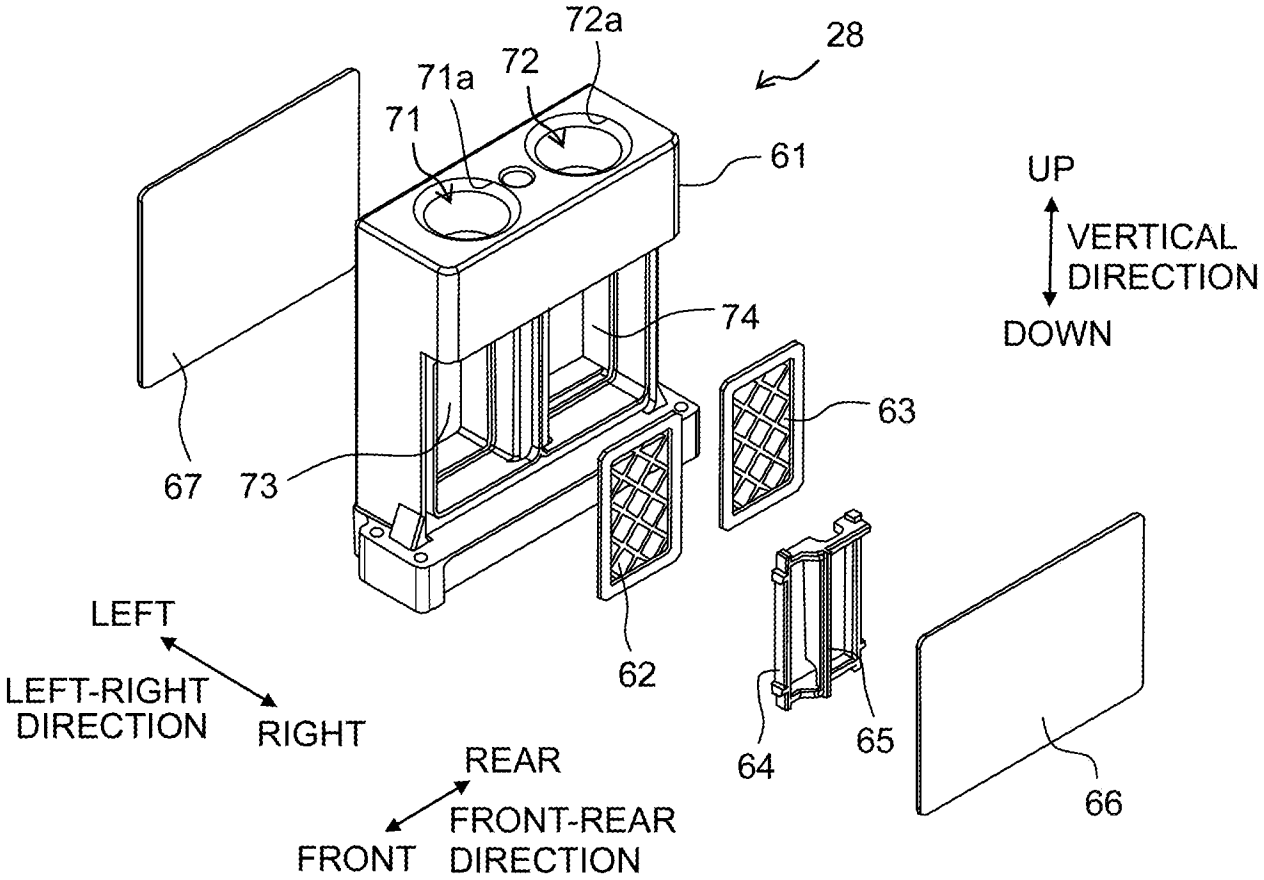
FIG. 9 is an exploded perspective view of a case.

As depicted in FIGS. 7 and 8, the head 21 is provided with a head chip 31 and a head holder 32. The head chip 31 has a substantially rectangular parallelepiped shape in which lengths in the left-right direction and in the front-rear direction are longer than that in the vertical direction, and the length in the left-right direction is longer than the length in the front-rear direction. As depicted in FIG. 8, the head chip 31 is provided with a channel forming member 33 and a piezoelectric actuator 34. The channel forming member 33 has ink channels such as a plurality of nozzles 10, a plurality of pressure chambers 35, four manifold channels 36*a* to 36*d*, etc.

The plurality of nozzles 10 are formed in the nozzle surface 31*a* (see FIG. 5) that is the lower surface of the head chip 31. As depicted in FIG. 8, the nozzle surface 31*a* has a length in the left-right direction which is longer than that in the front-rear direction. Namely, the left-right direction is the longitudinal direction of the nozzle surface 31*a*, and the front-rear direction is the short direction of the nozzle surface 31*a*. The plurality of nozzles 10 are aligned in the left-right direction to thereby form a nozzle row 9. The head chip 31 has eight pieces of the nozzles row 9 which are arranged side by side in the front-rear direction.

Each of the pressure chambers 35 is present corresponding to one of the nozzles 10. Namely, the plurality of pressure chambers 35 are present individually corresponding to the plurality of nozzles 10, respectively. The plurality of pressure chambers 35 are located at positions above the plurality of nozzles 10, respectively. Each of the plurality of pressure chambers 35 has a substantially elliptical planar shape. Further, pressure chambers 35, which are included in the plurality of pressure chambers 35 and which correspond to nozzles 10, among the plurality of nozzles 10, forming an odd-numbered nozzle row 9 from the front, overlap with the nozzles 10 in the vertical direction at front end portions of the pressure chambers 35, respectively, and are connected to the nozzles 10 via non-illustrated descender channels. On the other hand, pressure chambers 35, which are included in the plurality of pressure chambers 35 and which correspond to nozzles 10, among the plurality of nozzles 10, forming an even-numbered nozzle row 9 from the front, overlap with the nozzles 10 in the vertical direction at rear end portions of the pressure chambers 35, respectively, and are connected to the nozzles 10 via non-illustrated descender channels.

The four manifold channels 36*a* to 36*d* are located between the plurality of nozzles 10 and the plurality of pressure chambers 35 in the vertical direction. The manifold channel 36*a* is located between first and second nozzle rows 9 from the front in the front-rear direction, and extends in the left-right direction over pressure chambers 35, among the plurality of pressure chambers 35, corresponding to these two nozzle rows 9. Further, the manifold channel 36*a* and the pressure chambers 35 corresponding to the first and second nozzle rows 9 from the front are connected via non-illustrated individual throttle channels, etc., respectively. Furthermore, the manifold channel 36*a* extends up to a left end portion of the channel forming member 33, and has an opening 37*a* which in open in the upper surface of the channel forming member 33.

The manifold channel 36*b* is located between third and fourth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*b* and the pressure chambers 35 corresponding to the third and fourth nozzle rows 9 from the front are connected via non-illustrated individual throttle channels, etc., respectively. Furthermore, the manifold channel 36*b* extends up to the left end portion of the channel forming member 33, and has an opening 37*b* which in open in the upper surface of the channel forming member 33. Moreover, a right end portion of the manifold channel 36*a* and a right end portion of the manifold channel 36*b* are connected to each other.

The manifold channel 36*c* is located between fifth and sixth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*c* and the pressure chambers 35 corresponding to the fifth and sixth nozzle rows 9 from the front are connected via non-illustrated individual throttle channels, etc., respectively. Furthermore, the manifold channel 36*c* extends up to the left end portion of the channel forming member 33, and has an opening 37*c* which in open in the upper surface of the channel forming member 33.

The manifold channel 36*d* is located between seventh and eighth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*d* and the pressure chambers 35 corresponding to the seventh and eighth nozzle rows 9 from the front are connected via non-illustrated individual throttle channels, etc., respectively. Furthermore, the manifold channel 36*d* extends up to the left end portion of the channel forming member 33, and has an opening 37*d* which in open in the upper surface of the channel forming member 33. Moreover, a right end portion of the manifold channel 36*c* and a right end portion of the manifold channel 36*d* are connected to each other.

Further, the openings 37*a* to 37*d* in the upper surface of the channel forming member 33 are covered by filters 38*a* to 38*d*, respectively. The filters 38*a* to 38*d* are configured to prevent any foreign matter or substance in the ink, etc., from flowing from the openings 37*a* to 37*d* to the manifold channels 36*a* to 36*d*, respectively. Note that since the case 27 has filters 62 and 63 and that the foreign matter in the ink, etc., is captured mainly by the filters 62 and 63, as will be described later on, it is allowable that the filters 38*a* to 38*d* are omitted.

The piezoelectric actuator 34 is located on the upper surface of the channel forming member 33. The piezoelectric actuator 34 is configured to change the volumes of the pressure chambers 35. By changing the volume of a certain pressure chamber 35 included in the plurality of pressure chambers 35, pressure is applied to the ink inside the certain pressure chamber 35. By applying the pressure to the ink inside the certain pressure chamber 35, the ink is jetted from a nozzle 10 included in the plurality of nozzles 10 and corresponding to and communicated with the certain pressure chamber 35. Here, as depicted in FIG. 8, the piezoelectric actuator 34 is provided with a piezoelectric layer 41, a plurality of individual electrodes 42, etc. The piezoelectric layer 41 extends over the plurality of pressure chambers 35. Each of the plurality of individual electrodes 42 is present corresponding to one of the pressure chambers 35. Namely, the plurality of individual electrodes 42 are present to individually correspond to the plurality of pressure chambers 35, respectively. Each of the individual electrodes 42 overlaps with a central portion of one of the pressure chambers 35. Further, the plurality of individual electrodes 42 are located on the upper surface of the piezoelectric layer 41. A portion, of the piezoelectric layer 41, in which each of the individual electrodes 42, the piezoelectric layer 41 and the central portion of one of the pressure chambers 35 overlap with one another in the vertical direction, is a driving element 43. Namely, the number of the driving element 43 is same as the number of the plurality of individual electrodes 42 (or of the plurality of nozzles 10). Note that the configuration of the piezoelectric actuator 34 itself is publicly known, and thus any detailed explanation therefor will be omitted.

The head holder 32 (see a two-dot chain line in FIG. 8) is a metallic frame having a substantially rectangular parallelepiped shape. The head holder 32 has lengths in the front-rear direction and in the left-right direction which are longer than that in the vertical direction, and thickness along the vertical direction. Further, the head holder 32 has the lengths in the front-rear direction and in the left-right direction which are longer than those of the head chip 31 to some extent. Further, similarly to the head chip 31, the head holder 32 also has the length in the left-right direction which is longer than the length in the front-rear direction. The head holder 32 is located on the upper surface of the head chip 31. The head holder 32 is formed with a substantially rectangular through hole 51 (see a two-dot chain line in FIG. 8). The through hole 51 is positioned at a location closer to the right side of the head holder 32. The piezoelectric layer 41 and the plurality of individual electrodes 42 are exposed from the through hole 51. Further, through holes 52*a* to 52*d* are formed in a left end portion of the head holder 32. The through hole 52*a* overlaps with the opening 37*a*, the through hole 52*b* overlaps with the opening 37*b*, the through hole 52*c* overlaps with the opening 37*c*, and the through hole 52*d* overlaps with the opening 37*d*, in the vertical direction. Further, openings at the upper end of the through holes 52*a* and 52*d* are inlets 52*a*1 and 52*d*1 (see FIG. 7), respectively, via which the ink inflows into the head 21. Furthermore, openings at the upper end of the through holes 52*b* and 52*c* are outflow apertures 52*b*1 and 52*c*1 (see FIG. 7), respectively, via which the ink flows out of the head 21. With this, in the head 21, the inlets 52*a*1, 52*d*1 and the outflow apertures 52*b*1, 52*c*1 are arranged side by side with respect to the plurality of nozzles 10 in the left-right direction.

As depicted in FIG. 7, a sealing member 55 is located in the upper surface of the left end portion of the head holder 32. The sealing member 55 is a co-called packing formed of a rubber material, etc. The sealing member 55 extends in the front-rear direction over the through holes 52*a* to 52*d*. The sealing member 55 has a seal portion 56*a* and a seal portion 56*d* at portions thereof which overlap with the through hole 52*a* and the through hole 52*d*, respectively. The seal portions 56*a* and 56*d* each have a cylindrical shape extending in the vertical direction. The seal portion 56*a* is connected to the inlet 52*a*1, and the seal portion 56*d* is connected to the inlet 52*d*1. Further, the sealing member 55 has a seal portion 56*b* at a portion thereof which spans over the through hole 52*b* and the through hole 52*c*. The seal portion 56*b* has a cylindrical shape extending in the vertical direction, and is connected to the two outflow apertures 52*b*1 and 52*c*1. Note that the head holder 32 and the sealing member 55 is adhered to each other with, for example, a silicone-based adhesive.

<COF Substrate>

As depicted in FIG. 7, the COF substrate 22 has flexibility, and is connected to the plurality of individual electrodes 42 by being joined to the upper surface of the piezoelectric layer 41. Further, the COF substrate 21 is drawn to the both sides in the left-right direction from a joining portion, at which the COF substrate is joined to the piezoelectric layer 41, and is bent upwardly at these drawn portions. Further, forward end portions, of the COF substrate 21, of the two portions which are drawn to the both sides in the left-right direction, are located immediately above the piezoelectric layer 41. Two driver ICs are mounted respectively on these forward end portions of the two portions, of the COF substrate 21, which are drawn to the both sides in the left-right direction (see FIG. 7). The two driver ICs 50 are each elongated in the front-rear direction, and are arranged side by side in the left-right direction. The driver ICs 50 are configured to drive the piezoelectric actuator 34 (the plurality of driving elements 34).

<Heat Spreader>

Figure 6A:
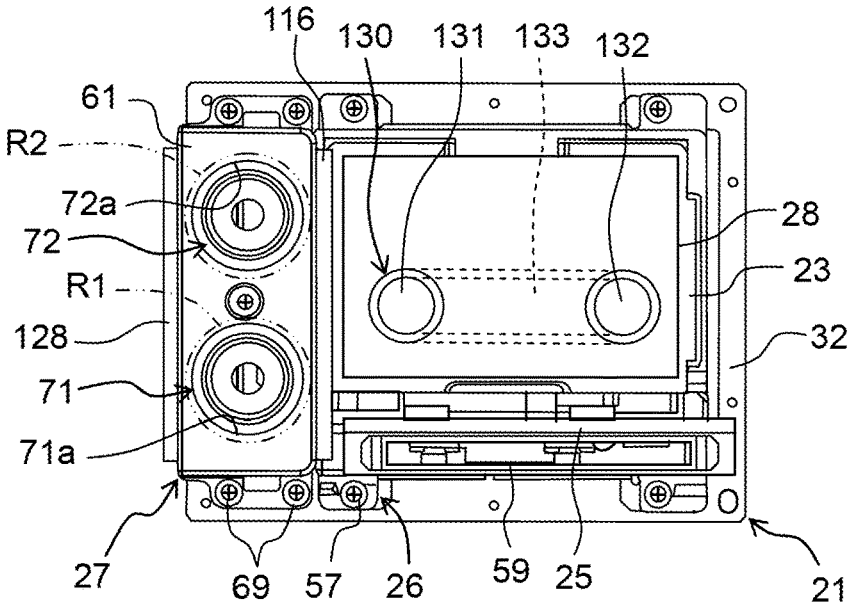
Figure 6B:
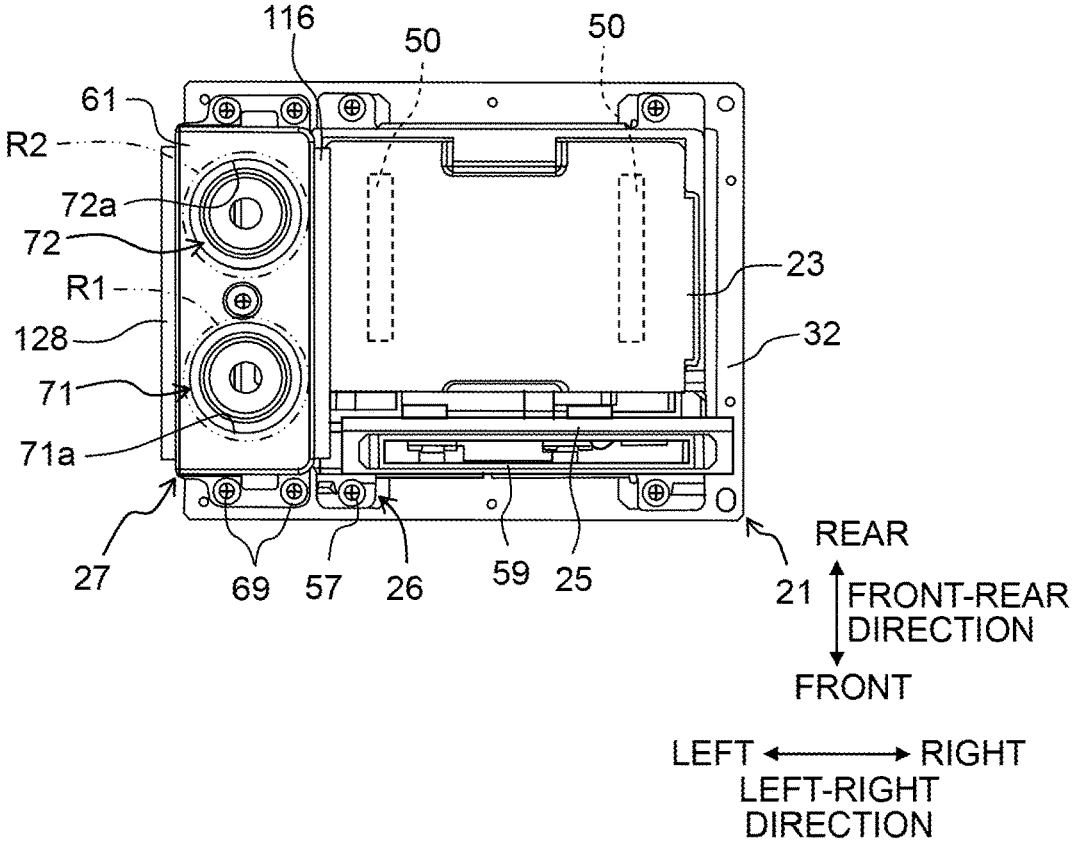
FIG. 6B is a view of the head module of FIG. 6A from which a cooler is removed.

As depicted in FIGS. 6A, 6B and 7, the heat spreader 23 is a plate made of a metallic material, etc. The heat spreader 23 extends over the two driver ICs at a location above the COF substrate 22. Namely, in the vertical direction, the driver ICs 50 are located between the heat spreader 23 and the head 21. Further, the heat spreader 23 makes contact with the two driver ICs 50.

<Flexible Substrate>

The flexible substrate 24 is a FPC (Flexible Printed Circuit) having flexibility. As depicted in FIG. 7, the flexible substrate 24 is connected to the two forward end portions of the COF substrate 22. The flexible substrate 24 extends frontwardly from connection portions at which the flexible substrate 24 make contact with the COF substrate 22, and is bent upwardly from a location at which the flexible substrate 24 overlaps with a forward end portion of the head holder 32 in the vertical direction. Further, as depicted in FIG. 3, an upper end portion of the flexible substrate 24 is connected to the rigid substrate 25.

<Rigid Substrate, Substrate Holder>

The rigid substrate 25 is configured to transmit or send a control signal, etc., to the two driver ICs 50, and is constructed to have a substantially rectangular parallelepiped shape. In the rigid substrate 25, the length in the vertical direction is the longest, and the length in the front-rear direction is the shortest. Namely, the thickness of the rigid substrate 25 is along the front-rear direction. Further, as depicted in FIGS. 6A and 6B, the rigid substrate 25 is located on the front side relative to (in front of) the heat spreader 23, and the rigid substrate 25 and the heat spreader 23 are arranged side by side in the front-rear direction. Furthermore, the rigid substrate 25 is positioned with a spacing distance with respect to the heat spreader 23 in the front-rear direction, and does not overlap with the heat spreader 23 in the vertical direction. Moreover, the rigid substrate 25 has a connector 59 (an example of a "second connector") on an upper end portion of the rigid substrate 25. The connector 59 is connected to a connector K which is located in the inside of the accommodating section 12*a*. Namely, the connector 59 is configured to electrically connect the rigid substrate 25 to the printing apparatus 1.

Figure 3:
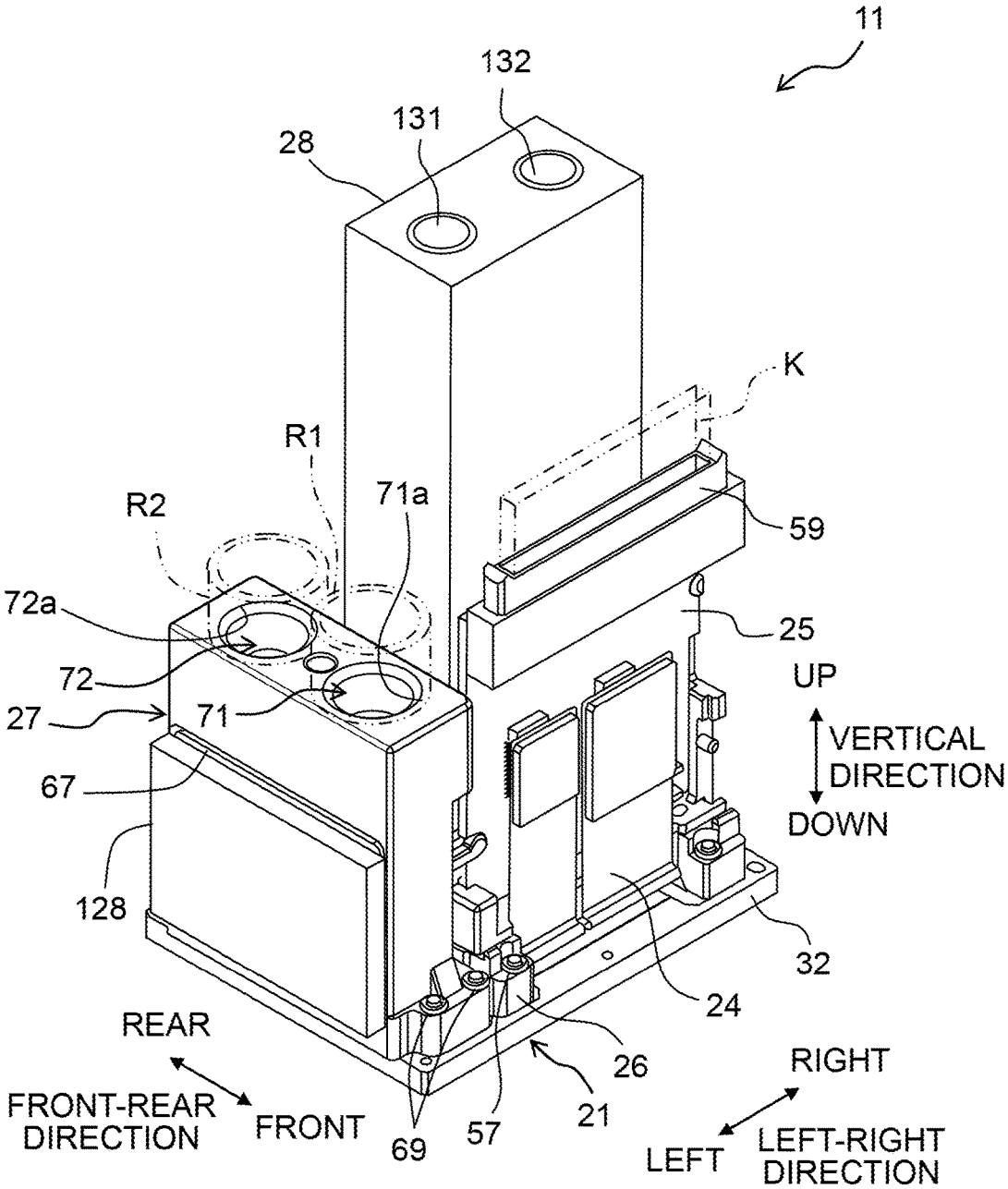
FIG. 3 is a perspective view of a head module.

As depicted in FIG. 3, the substrate holder 26 is fixed to the upper surface of the head holder 32 with a screw 57, and supports the rigid substrate 25. With this, a lower end portion of the rigid substrate 25 is supported by the head holder 32. Here, as depicted in FIGS. 6A and 6B, the rigid substrate 25 and the substrate holder 26 are overlapped with the head holder 32 as seen from the vertical direction, and do not protrude from (beyond) the head holder 32 in any of the front-rear direction and the left-right direction. With this, the rigid substrate 25 is supported by the head holder 32 within a projected plane of the head holder 32 in the vertical direction.

<Case>

The case 27 is formed to have a substantially rectangular parallelepiped shape, as depicted in FIGS. 3 to 6A, 6B. In the case 27, the lengths thereof are longer in an ascending order of: the length in the left-right direction, the length in the front-rear direction, and the length in the vertical direction. Further, the case 27 has the length in the front-rear direction which is substantially same as that of the head holder 32. Furthermore, the case 27 has the length in the left-right direction which is shorter than that in the head holder 32. Moreover, the case 27 has the length in the vertical direction which is longer than that of the head 32. Further, the case 27 is located on the upper surface of the left end portion of the head holder 32, and is overlapped in the vertical direction with the inlets 52*a*1 and 52*d*1 and with the outflow apertures 52*b*1 and 52*c*1. With this, the inlets 52*a*1, 52*d*1 and the outflow apertures 52*b*1, 52*c*1 are arranged side by side with the case 27 in the vertical direction. Furthermore, as depicted in FIGS. 6A and 6B, the case 27 and the heat spreader 23 are arranged side by side in the left-right direction, and the case 27 and the rigid substrate 25 are arranged side by side in the left-right direction.

As depicted in FIGS. 3 to 6A, 6B and FIGS. 9 to 15, the case 27 is provided with a case body 61, two filters 62 and 63, a frame 64, and two metallic plates 66 and 67. The case body 61 is a member having a substantially rectangular parallelepiped shape and formed of a synthetic resin material, and is fixed to the upper surface of the head holder 32 with screws 69.

Further, the case body 61 has an inflow port 71, an outflow port 72, two filter chambers 73 and 74, a heating chamber 75, a connecting channel 76, two connecting apertures for inflow 77*a* and 77*b*, and one connecting aperture for outflow 78.

As depicted in FIG. 3, the inflow port 71 is positioned at a front location in an upper portion of the case body 61. The inflow port 71 has an inlet 71*a* which is open in the upper surface of the case body 61. The inflow port 71 is connected to a connector R1 located in the inside of the accommodating section 12*a*. The connector R1 is communicated with the ink tank T via a non-illustrated tube. Namely, the inflow port 71 is connected to the ink tank T via the connector R1 and the non-illustrated tube.

As depicted in FIG. 3, the outflow port 72 is positioned at a rear location in the upper portion of the case body 61. The outflow port 72 has an outflow aperture 72*a* which is open in the upper surface of the case body 61. The outflow port 72 is connected to a connector R2 located in the inside of the accommodating section 12*a*. The connector R2 is communicated with the ink tank T via a non-illustrated tube. Namely, the outflow port 72 is connected to the ink tank T via the connector R2 and the non-illustrated tube. Further, by positioning the inflow port 71 at the front location in the upper portion of the case body 61 and by positioning the outflow port 72 at the rear location in the upper portion of the case body 61, the inlet 71*a* and the outflow aperture 72*a* are arranged side by side in the front-rear direction in the upper surface of the case body 61. Note that in this embodiment, any one or both of the inflow port 71 and the outflow port 72 is/are an example of a "first connector".

Figure 10:
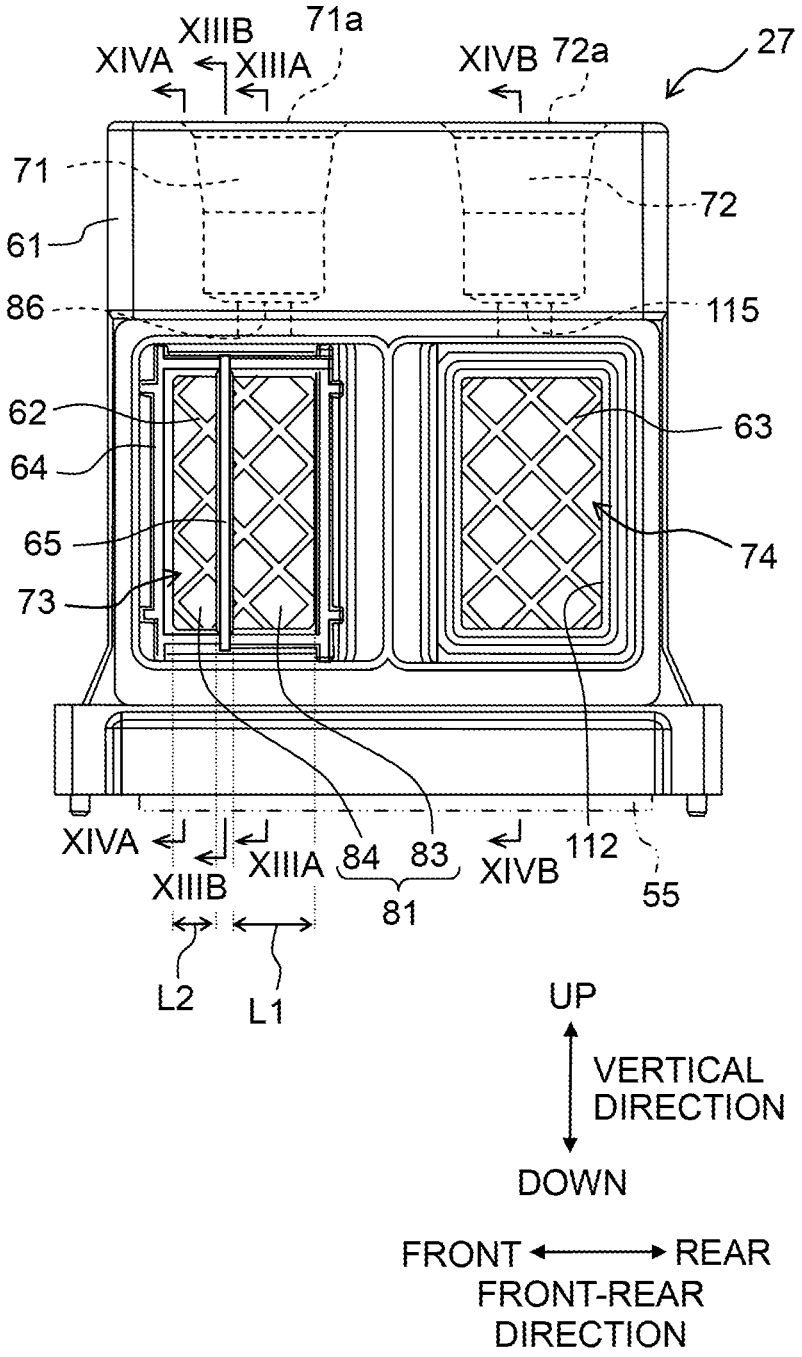
FIG. 10 is a view of the case as seen from the right side in a state that a metallic plate is removed from the case.

The filter chamber 73 is located at a position below the inflow port 71, and is connected to the inflow port 71. The filter 62 and the frame 64 are accommodated in the filter chamber 73, as depicted in FIG. 10. The filter 62 extends in the vertical direction, and has a filtering surface which is orthogonal to the left-right direction. Here, the term "filtering surface" means a surface formed with a large number of fine or minute holes (namely, mesh holes) for allowing an ink to pass therethrough. Further, the phrase that the "filtering surface (which) is orthogonal to the left-right direction" means that the direction in which the ink flows in the mesh holes is parallel to the left-right direction. Note that the filtering surface is not limited to or restricted by being orthogonal to the left-right direction, and may be inclined to some extent with respect to a plane orthogonal to the left-right direction.

Figure 13B:
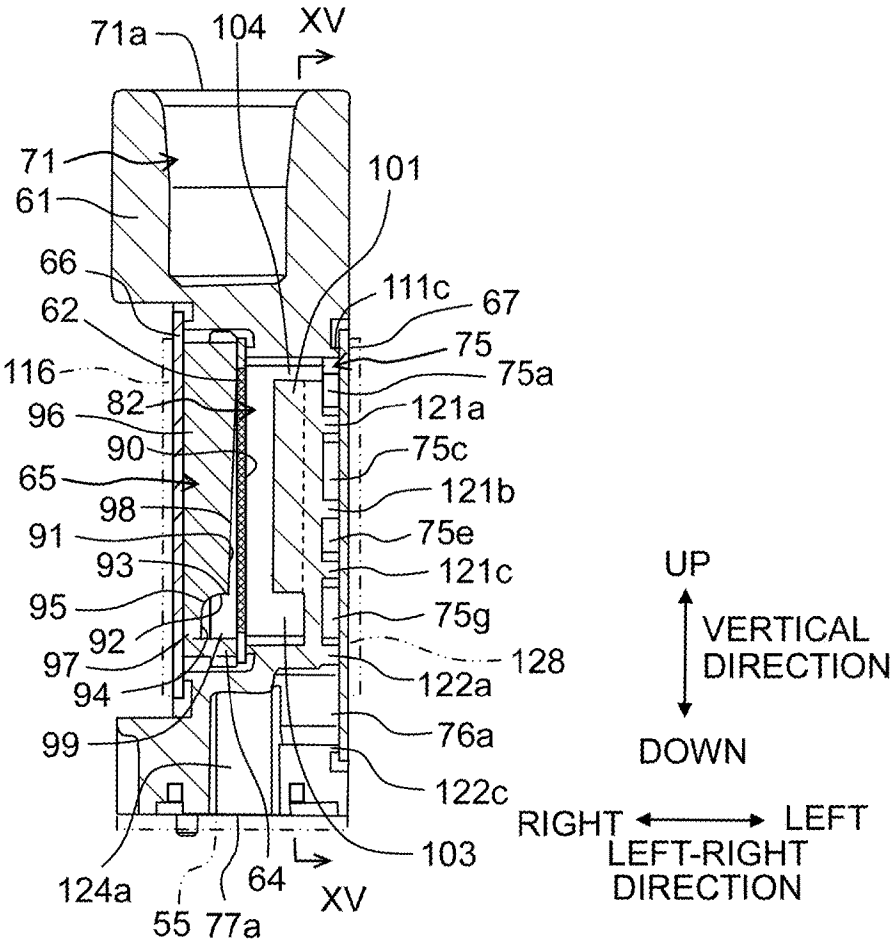
FIG. 13B is a cross-sectional view of FIG. 10 taken along a XIIIB-XIIIB line of FIG. 10, in the state that the metallic plate is attached.
Figure 13A:
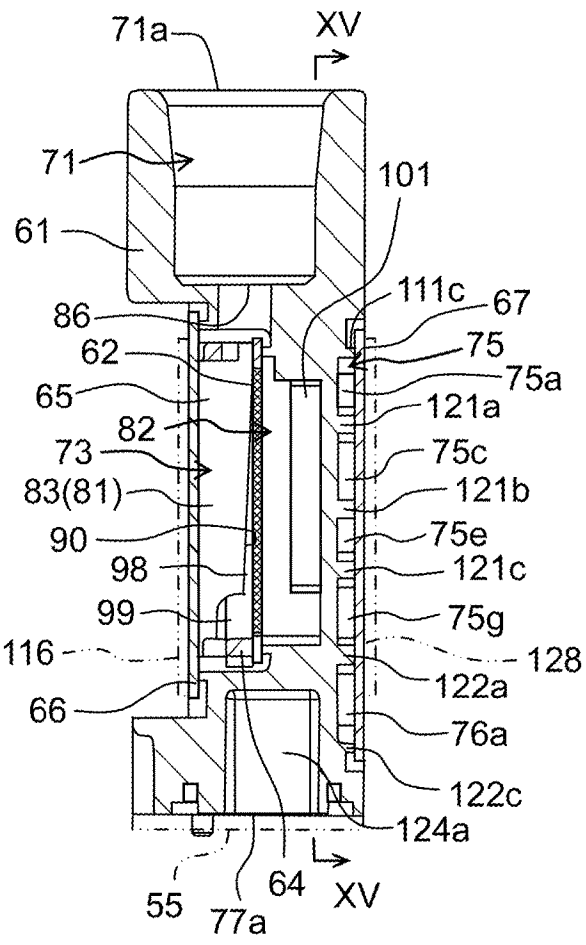
FIG. 13A is a cross-sectional view of FIG. 10 taken along a XIIIA-XIIIA line of FIG. 10, in a state that the metallic plate is attached.

As depicted in FIG. 13A, in the filter chamber 73, a portion on the right side relative to the filter 62 (on the upstream side in the flow of the ink relative to the filter 62) is an inflow liquid chamber 81, and a portion on the left side relative to the filter 62 (on the downstream side in the flow of the ink relative to the filer 62) is an outflow liquid chamber 82. The frame 64 is a frame having a substantially rectangular shape and is formed of a synthetic resin material. As depicted in FIG. 13A, the frame 64 is arranged in the inside of the liquid inflow chamber 81. Further, the filter 62 is fixed to the case body 61 and to a rear surface of the frame 64.

As depicted in FIG. 10, the frame 64 has a first wall 65. The first wall 65 extends in the vertical direction in the inflow liquid chamber 81, and both end portions in the vertical direction of the first wall 65 are supported by the frame 64. Owing to the presence of the first wall 65, a portion, in the inflow liquid chamber 81, on the rear side relative to the first wall 65 is a first liquid chamber 83; and a portion, in the inflow liquid chamber 81, on the front side relative to the first wall 65 is a second liquid chamber 84. As depicted in FIG. 10, an inlet aperture 86 via which the ink inflows into the first liquid chamber 83 is formed in an upper end portion of the first liquid chamber 83. The inlet 86 is connected to the inflow port 71. The first wall 65 is located, in the front-rear direction, at a position in front of (on the front side relative to) the center of the inflow liquid chamber 81. With this, a length L2 in the front-rear direction of the second liquid chamber 84 is shorter than a length L1 in the front-rear direction of the fist liquid chamber 83. Here, the length in the left-right direction of the inflow chamber 81 is substantially constant regardless of the position in the vertical direction. Accordingly, a cross section, of the second liquid chamber 84, which is orthogonal to the vertical direction, is smaller than a cross section, of the first liquid chamber 83, which is orthogonal to the vertical direction.

Further, as depicted in FIGS. 13A and 13B, a left edge 90, of the first wall 65, which faces the filter 62 has a first side 91 and a second side 92. The first side 91 extends downwardly from the upper end of the first wall 65. Further, the first side 91 is inclined with respect to the vertical direction such that the first side 91 is located more rightwardly as the first side extends further downwardly. Namely, the first side 91 is separated away from the filter 63 in the left-right direction to a progressively greater extent as the first side 65 extends further downwardly.

The second side 92 extends in the left-right direction, and a left end of the second side 92 is connected to a lower end of the first side 91. Note that a point at which the first side 91 and the second side 92 are connected to each other (the lower end of the first side 91, the left end of the second side 92) is a point of intersection 93 between the first side 91 and the second side 92. Further, in the left edge 90, a third side 94 is positioned at a location below the second side 92. The third side 94 extends in the vertical direction up to a lower end of the left edge 90. Furthermore, a curbed portion 95 which is curbed so as to project toward the inner side of the first wall 65 and which connects the right end of the second side 92 and the upper end of the third side 94 is located between the second side 92 and the third side 94.

Moreover, owing to the edge 90 of the first wall 95 having the above-described configuration, a gap 98 is defined between the filter 62 and a first area 96, of the first wall 65, which is located above the intersection point 93, and a gap 99 is defined between the filter 62 and a second area 97, of the first wall 65, which is located below the intersection point 93. Namely, the first wall 65 is separated away from the filter 62 with a spacing distance therefrom in the left-right direction, at the first area 96 and the second area 97. Further, in the second area 97, the spacing distance in the left-right direction is greater than that in the first area 96. Here, in the vertical direction, the second area 97 is located at a position below the center of the first wall 65. Further, in the vertical direction, the height of the second area 97 is preferably about one third the height of the first wall 65.

Furthermore, a cross-sectional area S3 of a cross section, of the gap 99 between the second area 97 and the filter 62, which is orthogonal to the front-rear direction is smaller than the cross-sectional area Si of the cross section, of the first liquid chamber 83, which is orthogonal to the vertical direction and the cross-sectional area S2 of the cross section, of the second liquid chamber 84, which is orthogonal to the vertical direction.

As depicted in FIGS. 13A and 13B, a second wall 101 is formed in a wall surface, of the outflow liquid chamber 82, which faces the filter 63 in the left-right direction. The second wall 101 projects along the left-right direction, and is separated away from the filter 63 in the left-right direction. Namely, the second wall 101 projects toward the filter 63, and a forward end portion of the second wall 101 is separated away from the filter 63.

A lower end of the second wall 101 is located at a position above the lower end of the outflow liquid chamber 82. Namely, the second wall 101 is located at a position above the lower end of the liquid outflow chamber 82 with a spacing distance from the lower end. With his, a gap 103 is defined between the second wall 101 and the lower end of the liquid outflow chamber 82; the gap 103 communicates a front portion, of the outflow liquid chamber 82, located on the front side relative to the second wall 101 and a rear portion, of the liquid outflow chamber 82, which is located on the rear side relative to the second wall 101.

The upper end of the second wall 101 is located at a positon below the upper end of the outflow liquid chamber 82. Namely, the second wall 101 is located at the position below the upper end of the outflow liquid chamber 82, with a spacing distance therefrom. With this, a gap 104 is defined between the second wall 101 and the upper end of the liquid outflow chamber 82; the gap 104 communicates the front portion, of the outflow liquid chamber 82, located on the front side relative to the second wall 101 and the rear portion, of the liquid outflow chamber 82, which is located on the rear side relative to the second wall 101.

Figure 15:
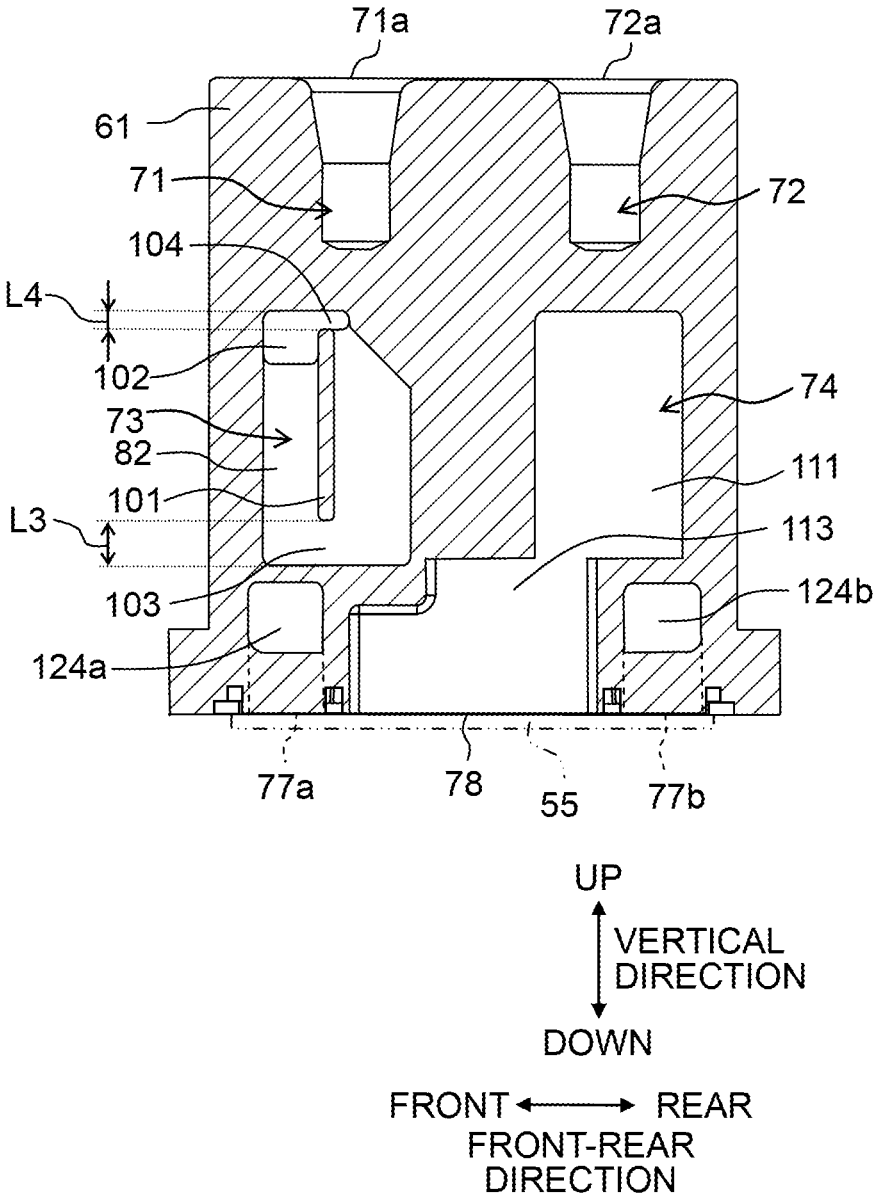
FIG. 15 is a view of FIG. 13A, 13B, 14A and 14B taken along a XV-XV line thereof.

Further, as depicted in FIG. 15, a length L4 in the vertical direction between the upper end of the second wall 101 and the upper end of the outflow liquid chamber 82 (the length in the vertical direction of the gap 104) is shorter than a length L3 of the spacing distance between the lower end of the second wall 101 and the lower end of the outflow liquid chamber 82 (the length in the vertical direction of the gap 103). Here, the length in the left-right direction of the liquid outflow chamber 82 is substantially constant regardless of the position in the front-rear direction. Accordingly, a cross section of the gap 104, which is orthogonal to the front-rear direction is greater than a cross section, of the gap 103, which is orthogonal to the front-rear direction.

Figure 14B:
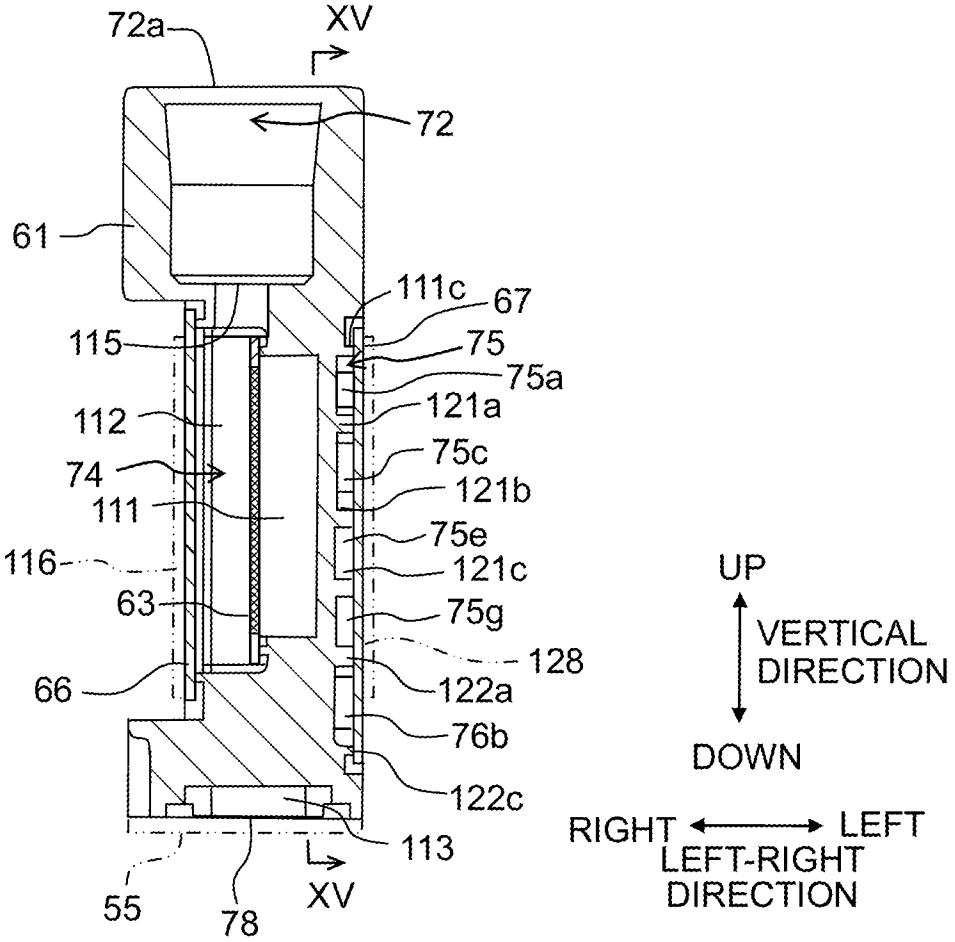
FIG. 14B is a cross-sectional view of FIG. 10 taken along a XIVB-XIVB line of FIG. 10, in the state that the metallic plate is attached.
Figure 14A:
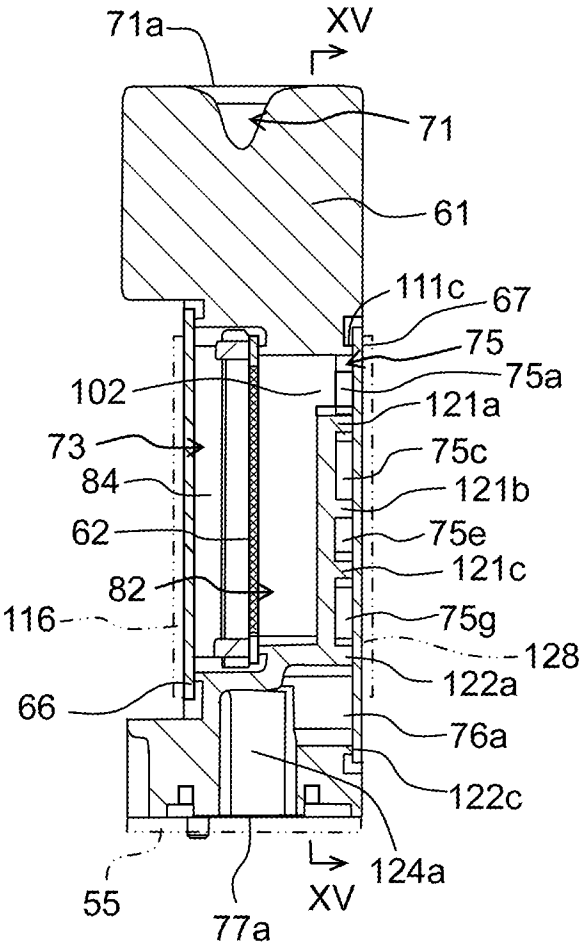
FIG. 14A is a cross-sectional view of FIG. 10 taken along a XIVA-XIVA line of FIG. 10, in the state that the metallic plate is attached.

Further, as depicted in FIG. 14A, the outflow liquid chamber 82 has a communicating hole 102 at an upper left portion of a rear wall thereof which faces the filter 63 in the left-right direction. The communicating hole 102 is configured to communicate the outflow liquid chamber 82 and the heating chamber 75 with each other.

The ink which has flowed from the inlet 71*a* into the case 27 flows from the inlet 86 into the first liquid chamber 83. The ink inside the first liquid chamber 83 flows to the second liquid chamber 84 via the gaps 98 and 99. Further, the ink in the first liquid chamber 83 and the second liquid chamber 84 passes through the filter 62 and then flows to the liquid outflow chamber 82. The ink inside the outflow liquid chamber 82 flows out of the outflow liquid chamber 82 and into the heating chamber 75 from the communicating hole 102.

The filter chamber 74 is located at a position below the outflow port 72 and on the rear side of (behind) the filter chamber 73, and is connected to the outflow port 72. The filter 63 is accommodated in the filter chamber 74. The filter 63 extends in the vertical direction, and has a filtering surface which is orthogonal to the left-right direction. Further, as depicted in FIG. 14B, in the filter chamber 74, a portion on the left side relative to the filer 63 is a liquid chamber 111, and another portion on the right side relative to the filter 63 is a liquid chamber 112. As depicted in FIG. 15, a channel 113 which extends along the vertical direction is formed in a portion, of the case 27, which is located at a position below the liquid chamber 111. In the channel 113, an upper end thereof is connected to the liquid chamber 111, and a lower end there of is connected to the outflow-connecting aperture 78. The outflow-connecting aperture 78 is overlapped in the vertical direction with the two outflow apertures 52*b*1 and 52*c*1 of the head 21 and with the seal portion 56*b* of the sealing member 55. With this, the two outflow apertures 52*b*1 and 52*c*1 of the head 21 are communicated with the outflow-connecting aperture 78. Further, the sealing member 55 makes contact with the upper surface of the head 21 (head holder 32) and with the lower surface of the case 27. With this, the ink is prevented from leaking out from a location between the two outflow apertures 52*b*1 and 52*c*1 and the outflow-connecting aperture 78. Furthermore, as depicted in FIG. 14B, an outflow aperture 115 is formed in the upper end portion of the liquid chamber 112; the outflow aperture 115 is configured to allow the ink in the inside of the liquid chamber 112 to outflow therefrom. The outflow aperture 115 is connected to the outflow port 72.

The ink, outflowed from the outflow apertures 52*b*1 and 52*c*1 of the head 21, flows into the case 27 from the outflow-connecting aperture 78, and flows into the liquid chamber 111 via the channel 113. The ink inside the liquid chamber 111 passes through the filter 63 and then flows into the liquid chamber 112. The ink inside the liquid chamber 112 flows out of the liquid chamber 112 from the outflow aperture 115. The ink outflowed from the outflow aperture 115 of the liquid chamber 112 further flows out of the case 27 from the outflow aperture 72*a* of the case 27 toward the ink tank T.

As depicted in FIGS. 9, 13A, 13B, 14A and 14B, the metallic plate 66 is a substantially rectangular plate formed of a metallic material, and is joined to a right end surface of the case body 61. With this, the right end of the filter chamber 73 (inflow liquid chamber 81) and the right end of the filer chamber 74 (liquid chamber 112) are defined by the metallic plate 66. Further, as depicted in FIGS. 13A and 13B, a right end surface of the first wall 65 is welded to the metallic plate 66. Furthermore, a heater 116 is arranged on an outer surface (right surface) of the metallic plate 66. The heater 116 is configured to heat the ink inside the filter chambers 73 and 74 by heating the metallic plate 66 and by transferring heat via the metallic plate 66.

Figure 11:
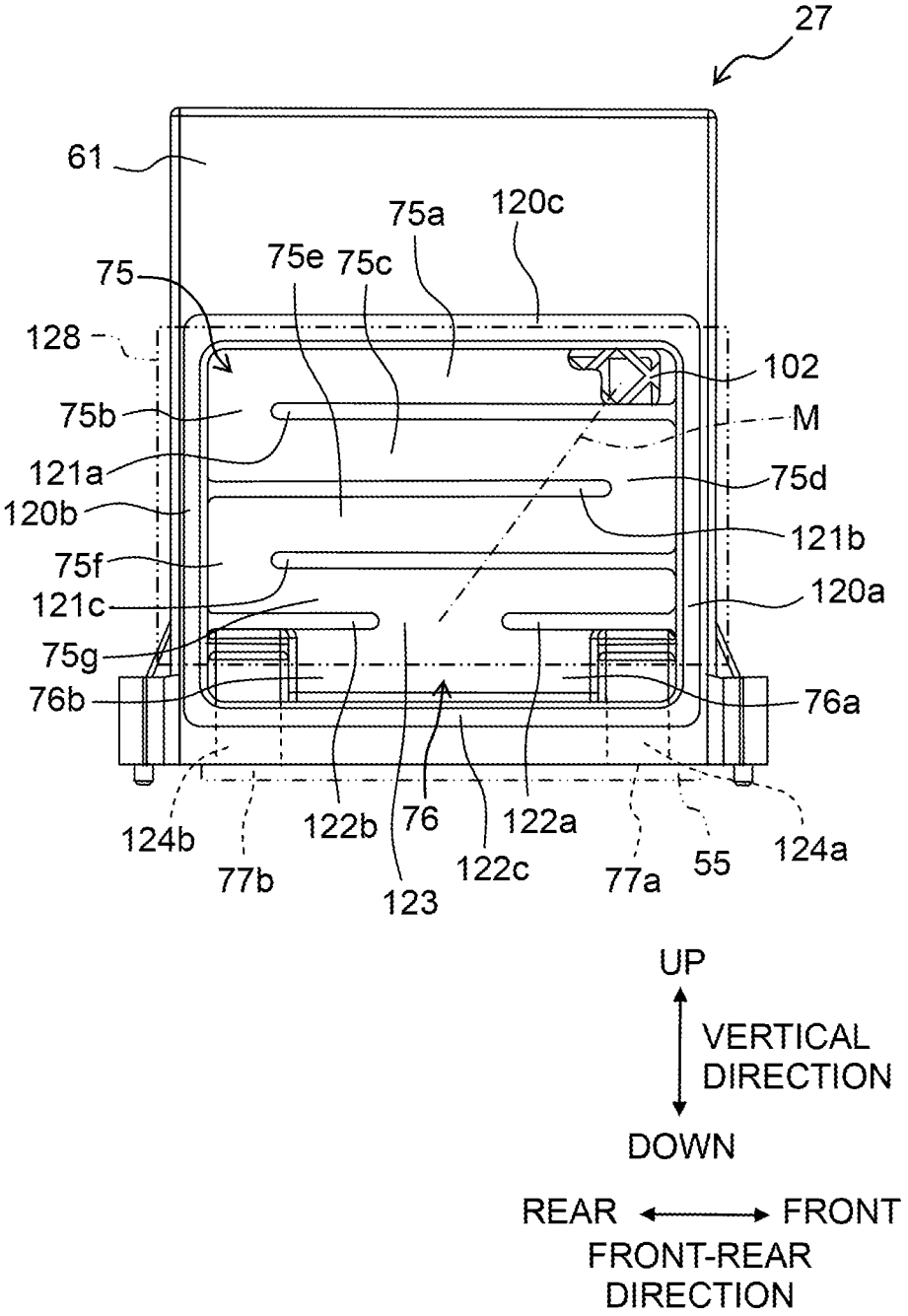
FIG. 11 is a view of the case as seen from the left side in the state that a metallic plate is removed from the case.
Figure 12A:
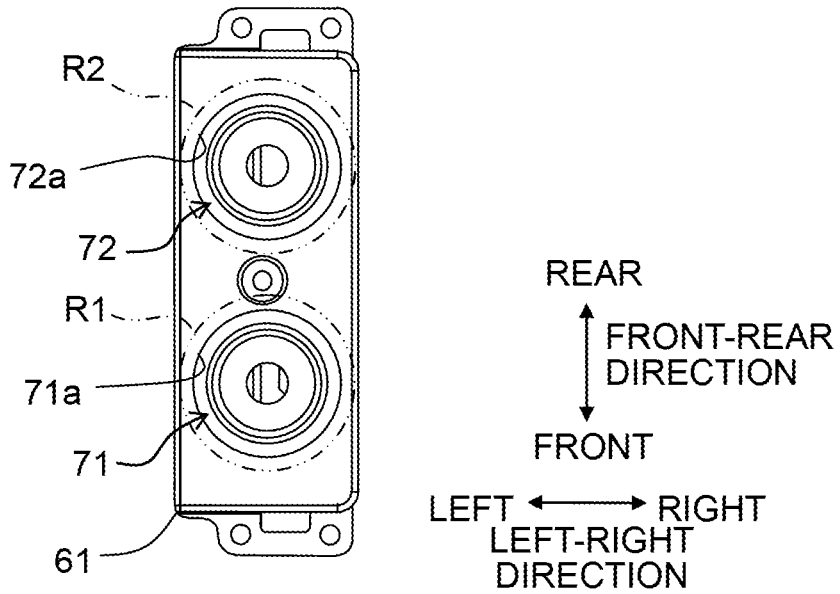
Figure 12B:
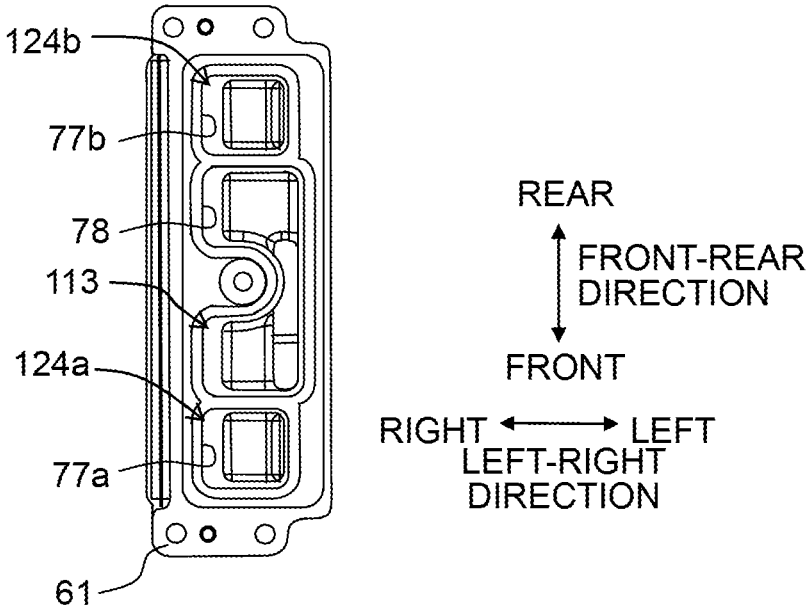
FIG. 12B is a view of the case as seen from the lower side.

As depicted in FIGS. 13A, 13B, 14A and 14B, the heating chamber 75 is located at a positon on the left side relative to the filter chambers 73 and 74. The heating chamber 75 is a space having a substantially rectangular shape as seen from the left-right direction. As depicted in FIG. 11, the communicating hole 102 is located at an upper front end portion of the heating chamber 75. Further, a first partition 121*a* is positioned at a location, of the heating chamber 75, which is immediately below the communicating hole 102. The first partition 121*a* extends parallel to the front-rear direction, from a wall 120*a* on the front side of the heating chamber 75 toward a wall 120*b* on the rear side of the heating chamber 75. Furthermore, a forward end portion of the first partition 121*a* is separated away from the wall 120*b*. Namely, the first partition 121*a* and the wall 120*b* are apart from each other in the front-rear direction, and a space 75*b* is present between the first partition 121*a* and the wall 120*b*.

Further, in the heating chamber 75, a second partition 121*b* is positioned at a location below the first partition 121*a*. The second partition 121*b* extends parallel to the front-rear direction from the wall 120*b* toward the wall 120*a*. Furthermore, a forward end portion of the second partition 121*b* is separated away from the wall 120*a*. Namely, the second partition 121*a* and the wall 120*a* are apart from each other in the front-rear direction, and a space 75*d* is present between the second partition 121*b* and the wall 120*a*. Moreover, in the heating chamber 75, a third partition 121*c* is positioned at a location below the second partition 121*b*. The third partition 121*c* extends parallel to the front-rear direction from the wall 120*a* toward the wall 120*b*. Further, a forward end portion of the third partition 121*c* is separated away from the wall 120*b*. Namely, the third partition 121*c* and the wall 120*b* are apart from each other in the front-rear direction, and a space 75*f* is present between the third partition 121*c* and the wall 120*b*.

Further, a first rib 122*a* and a second rib 122*a* are arranged each at a positon below the third partition 121*c*. The first rib 122*a* extends parallel to the front-rear direction from the wall 120*a* up to a position in the vicinity of a central portion in the front-rear direction of the heating chamber 75. The second rib 122*b* extends parallel to the front-rear direction from the wall 120*b* up to a position in the vicinity of the central portion in the front-rear direction of the heating chamber 75. Furthermore, the first rib 122*a* and the second rib 122*b* are separated from each other in the front-rear direction. Moreover, the first rib 122*a* and the second rib 122*b* have a same length in the front-rear direction. The first rib 122*a* and the second rib 122*b* define a lower end of the heating chamber 75. Further, a gap between the first rib 122*a* and the second rib 122*b* which are separated from each other defines a communicating hole 123 configured to communicate the heating chamber 75 and the connecting channel 76. By allowing the partitions 121*a* to 121*c* and the ribs 122*a* and 122*b* to be positioned as described above, each of the partitions 121*a* to 121*c* crosses a straight line M connecting the center of the communicating hole 102 in the front-rear direction with the center of the communicating hole 123 in the front-rear direction.

The ink inside the outflow liquid chamber 82 flows from the communicating hole 102 into the heating chamber 75. The ink flowed from the communicating hole 102 into the heating chamber 75 flows rearwardly in a space 75*a*. The space 75*a* is a space extending in the front-rear direction between a wall 120*c* on the upper side of the heating chamber 75 and the first partition 121*a*. Further, the ink flows into a space 75*c* via the space 75*b*, and flows frontwardly in the space 75*c*. The space 75*b* is a space defined between the forward end portion of the first partition 121*a* and the wall 120*b*. The space 75*c* is a space extending in the front-rear direction between the first partition 121*a* and the second partition 121*b*. Furthermore, the ink flows rearwardly in a space 75*e* via the space 75*d*. The space 75*d* is a space defined between the forward end portion of the second partition 121*b* and the wall 120*a*. The space 75*e* is a space extending in the front-rear direction between the second partition 121*b* and the third partition 121*c*. Moreover, the ink frons frontwardly in a space 75*g* via the space 75*f*, and reaches the communicating hole 123. The space 75*f* is a space defined between the forward end portion of the third partition 121*c* and the wall 120*b*. The space 75*g* is a space between the third partition 121*c* and the second rib 122*a*.

Further, a third rib 122*c* extending in the front-rear direction over the first rib 122*a* and the second rib 122*b* is located at a position below the first and second ribs 122*a* and 122*b*. The walls 120*a* and 120*b* of the heating chamber 75 extend to a location below the first and second ribs 122*a* and 122*b*, and both end portions in the front-rear direction of the third rib 122*c* are connected to the wall 120*a* and 120*b*, respectively.

The connecting channel 76 is a channel which extends in the front-rear direction, of which upper end is defined by the first and second ribs 122*a* and 122*b*, and of which lower end is defined by the third rib 122*c*. The connecting channel 76 has a first channel 76*a* and a second channel 76*b*. The first channel 76*a* is a portion, of the connecting channel 76, which is located on the front side relative to the communicating hole 123, of which upper and lower portions are defined respectively by the first rib 122*a* and the third rib 122*c*, and which extends in the front-rear direction. The second channel 76*b* is a portion, of the connecting channel 76, which is located on the rear side relative to the communicating hole 123, of which upper and lower portions are defined respectively by the second rib 122*b* and the third rib 122*c*, and which extends in the front-rear direction. The ink flowed into the connecting channel 76 from the communicating hole 123 is divided to flow in the first channel 76*a* and to flow in the second channel 76*b*.

Here, as described above, the first rib 122*a* and the second rib 122*b* have the same length in the front-rear direction, and the ribs 122*a*, 122*b* and 122*c* are parallel to one another. Therefore, the first channel 76*a* and the second channel 76*b* have a same length in the front-rear direction (channel length) and a same cross-sectional area of a cross section orthogonal to the front-rear direction (direction of the channel length). Further, the first channel 76*a* and the second channel 76*b* have a same inertance. The term "inertance" is a physical quantity indicating a degree of easiness of flowing of a liquid, and is expressed as $\rho(L/S)$, wherein $\rho$ represents the fluid density, L represents the length of a conduit channel via which a fluid flows, and S represents a cross-sectional area of a cross section orthogonal to the length direction of the channel via which the fluid flows. Further, this indicates that as the inertance is smaller, the fluid flows more easily. In the present embodiment, the configuration wherein the first channel 76*a* and the second channel 76*b* have the same inertance is not limited to or restricted by such a configuration that the first channel 76*a* and the second channel 76*b* have a strictly same inertance; it is allowable, for example, that the above configuration also encompasses such a configuration wherein although the first channel 76*a* and the second channel 76*b* have a same inertance in design, there is a difference to some extent in the inertance of the first channel 76*a* and the inertance of the second channel 76*b* due to any effect caused by a manufacturing error, etc.

Further, a channel 124*a* extending in the vertical direction is formed in the case 27 at a portion located at a position below a front end portion of the first channel 76*a*. An upper end of the channel 124*a* is connected to the first channel 76*a*, and a lower end of the channel 124*a* is the inflow-connecting aperture 77*a* which is open in the lower surface of the case 27. Furthermore, a channel 124*b* extending in the vertical direction is formed in the case 27 at a portion located at a position below a rear end portion of the second channel 76*b*. An upper end of the channel 124*b* is connected to the second channel 76*b*, and a lower end of the channel 124*b* is the inflow-connecting aperture 77*b* which is open in the lower surface of the case 27.

The inflow-connecting aperture 77*a* is overlapped, in the vertical direction, with the inlet 52*a*1 (see FIG. 7) of the head 21 and with the seal portion 56*a* (see FIG. 7) of the sealing material 55. With this, the inlet 52*a*1 of the head 21 and the inflow-connecting aperture 77*a* are communicated with each other. The inflow-connecting aperture 77*b* is overlapped, in the vertical direction, with the inlet 52*d*1 (see FIG. 7) of the head 21 and with the seal portion 56*d* (see FIG. 7) of the sealing material 55. With this, the inlet 52*d*1 of the head 21 and the inflow-connecting aperture 77*b* are communicated with each other. Further, the sealing material 55 makes contact with the upper surface of the head 21 (head holder 32) and the lower surface of the case 27. With this, the ink is prevented from leaking out from locations between the inlets 52*a*1, 52*d*1 and the inflow-connecting apertures 77*a*, 77*b*, respectively.

The ink flowing through the first channel 76*a* further flows downwardly through the channel 124*a*, flows out of the channel 124*a* from the inflow-connecting aperture 77*a*, and flows into the head 21 from the inlet 52*a*1. Further, the ink flowing through the second channel 76*b* further flows downwardly through the second channel 124*b*, flows out of the channel 124*b* from the inflow-connecting aperture 77*b*, and flows into the head 21 from the inlet 52*d*1.

The metallic plate 67 is a substantially rectangular plate formed of a metallic material; as depicted in FIGS. 13A, 13B, 14A and 14B, the metallic plate 67 is joined to a left end surface of the case body 61. With this, the left end of the heating chamber 75 and the left end of the connecting channel 76 are defined by the metallic plate 67. Further, a heater 128 is arranged on an outer surface (left surface) of the metallic plate 67. The heater 128 faces the heating chamber 75 and a substantially upper half portion of the connecting channel 76 in the left-right direction. The heater 128 is configured to heat the ink inside the heating chamber 75 and the connecting channel 76 by heating the metallic plate 67 and transferring heat via the metallic plate 67.

Figure 16A:
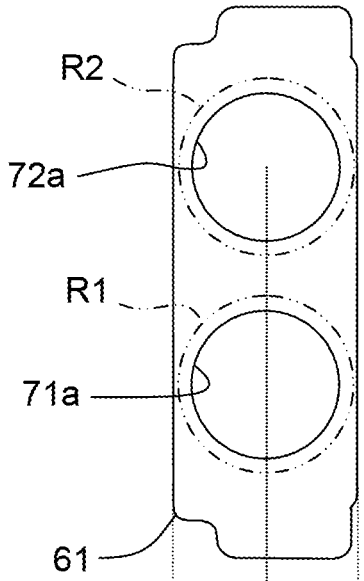
FIG. 16A is a view depicting the positional relationship between an inlet and an outflow aperture on the upper surface of the case with respect to the outer shape of the case, as seen from the upper side.
Figure 16B:
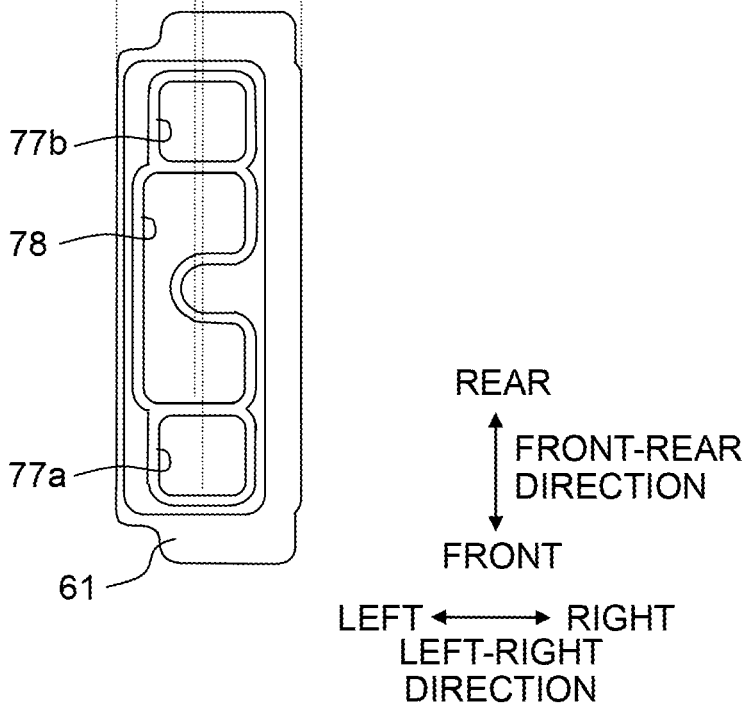
FIG. 16B is a view depicting the positional relationship between an inflow-connecting aperture and an outflow-connecting aperture on the lower surface of the case with respect to the outer shape of the case, as seen from the lower side.

Here, an explanation will be given about the positional relationship among the inlets 71*a*, 72*a*, the inflow-connecting apertures 77*a*, 77*b* and the outflow-connecting apertures 78*a* in the case 27. As depicted in FIGS. 16A and 16B, in the left-right direction, the center of the inlet 71*a* and the center of the outflow aperture 72*a* are located on the right side, namely located closer to the nozzles 10, relative to the centers of the inflow-connecting apertures 77*a*, 77*b* and the center of the outflow-connecting aperture 78.

<Cooler>

Figure 5:
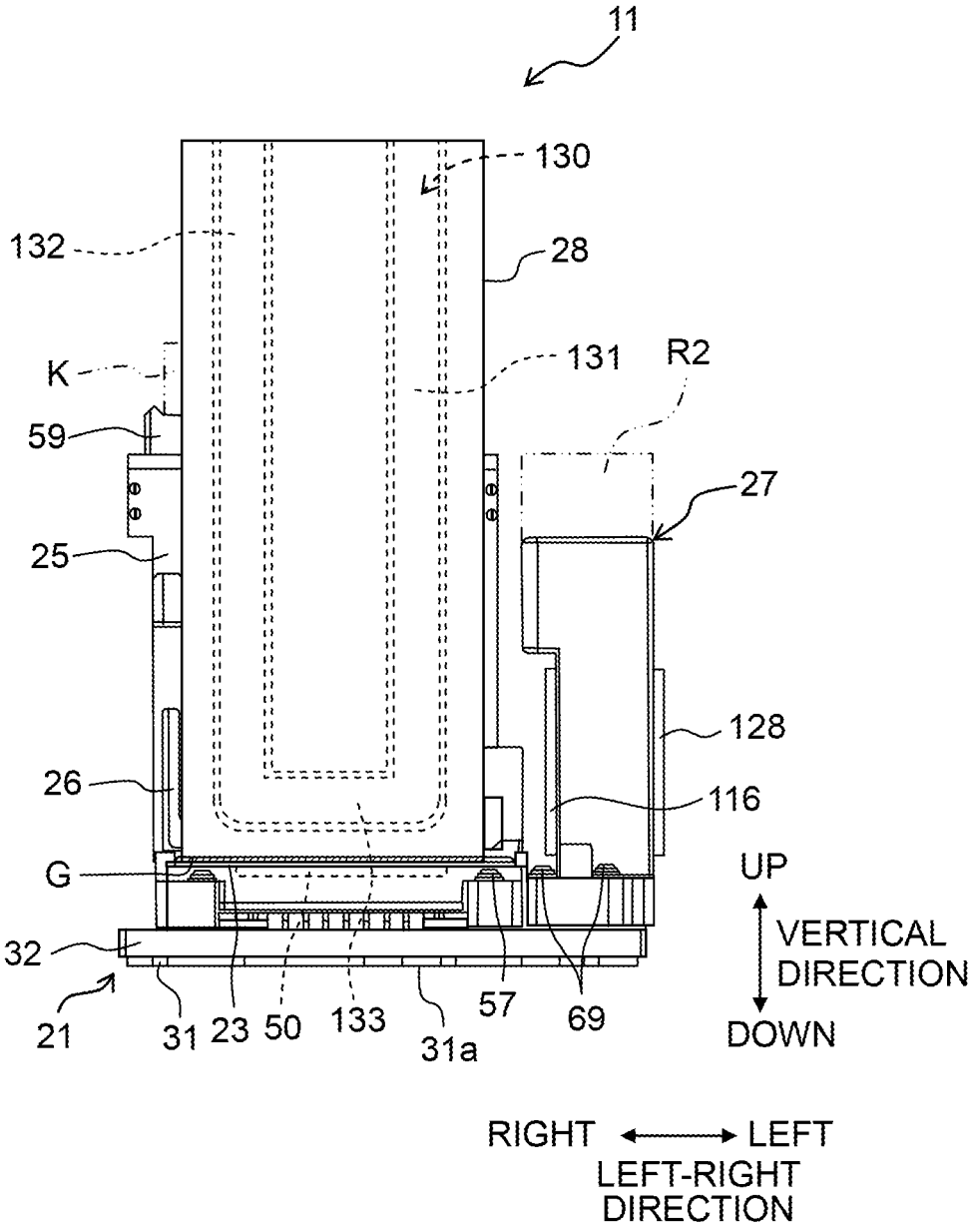
FIG. 5 is a view of the head module as seen from the rear side.

As depicted in FIGS. 3 to 6, the cooler 28 is configured to have a substantially rectangular parallelepiped shape which is elongated in the vertical direction, is arranged on the upper surface of the heat spreader 23, and is arrange side by side to the case 27 in the left-right direction. Further, as depicted in FIG. 5, a heat radiation grease G is located between the cooler 28 and the upper surface of the heat spreader 23. Namely, the cooler 28 and the heat spreader 23 are thermally connected to each other via the heat radiation grease G. Furthermore, the heat radiation grease G makes contact with the heat spreader 23 and the cooler 28. Note that in FIG. 5, the thickness of the heat radiation grease G is illustrated to be large, and the heat radiation grease G is indicated with a hatching so that the positon of the heat radiation grease G can be easily understood.

The cooler 28 has a cooling channel 130 which is formed in the inside of the cooler 28 and via which a coolant (cooling liquid) flows. As depicted in FIG. 6A, the cooling channel 130 is located at a position which is same in the front-rear direction as positions of the center of the heater 116 and the center of the heater 128. As depicted in FIGS. 4, 5, 6A and 6B, the cooling channel 130 has a first portion 131, a second portion 132 and a third portion 133. The first portion 131 is located at a position on the left side of the cooler 28 and extends in the vertical direction. The second portion 132 is a downstream portion, of the cooler 28, which is on the downstream side in a flow of the coolant with respect to the first portion 131, is located on a portion on the right side of the cooler 28, and extends in the vertical direction. Namely, in the cooler 28, the first portion 131 is located to be closer in the left-right direction to the heaters 116 and 128 than the second portion 132, as depicted in FIGS. 5 and 6A. The third portion 133 extends in the left-right direction and connects a lower end portion of the first portion 131 and a lower end portion of the second portion 132, as depicted in FIGS. 5 and 6A. Further, in the cooling channel 130, the coolant flows in the first portion 131 from the upper side toward the lower side, flows in the third portion 133 from the left side toward the right side, and flows in the second portion 132 from the lower side toward the upper side. Namely, in the cooling channel 130, the coolant flows in an order of the first portion 131, the third portion 133 and the second portion 132.

The heat transferred from the driver ICs 50 to the heat spreader 23 is transferred from the heat spreader 23 to the cooler 28, and is released to the outside by the coolant flowing in the cooling channel 130. In this situation, the heat spreader 23 equalizes the heat transferred from the driver ICs 50.

<Purge Device>

Figure 17:
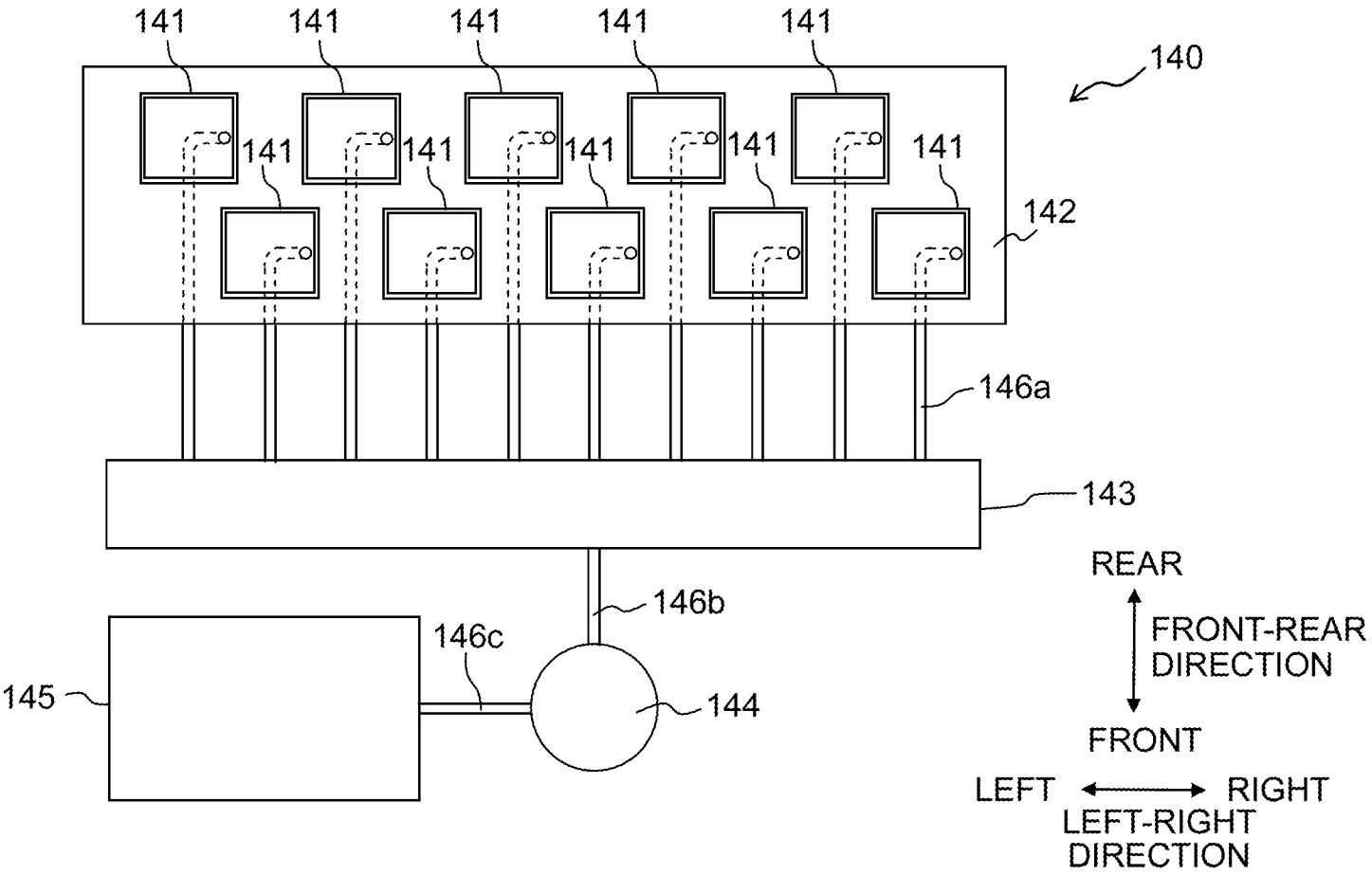
FIG. 17 is a view schematically depicting the configuration of a purge device.

Further, the printing apparatus 1 is provided with a purge device 140 depicted in FIG. 17, in addition to the configurations as described above. The purge device 140 is configured to perform a so-called suction purge for causing the ink inside the head module 11 to be jetted or discharged from the plurality of nozzles 10. The purge device 140 is provided with ten pieces of cap 141, a cap holder 142, a switching device 143, a pump 144 and a waste liquid tank 145.

The number of the cap 141 is same as the number of the head module 11. Namely, one piece of the cap 141 is present corresponding to one piece of the head module 11. The positional relationship among the ten caps 141 with one another is similar to the positional relationship among the ten head modules 11 with one another. Namely, in correspondence to that the ten head modules 11 are positioned in the staggered manner, the ten caps 141 are positioned in the staggered manner. The cap holder 142 is configured to hold the ten caps 141 such that the ten caps 141 have the above-described positional relationship. Further, the cap holder 142 is configured to be movable in the vertical direction and the horizontal direction (for example, the front-rear direction or the left-right direction) by a non-illustrated moving device. The moving device moves the cap holder 142 between a retracted position and a capping position. In a case that the suction purge is not performed, for example, as during the printing, etc., the cap holder 142 is located at the retracted positon at which the cap holder 142 does not overlap with the plurality of head modules 11 in the vertical direction. On the other hand, in a case that the suction purge is performed, the cap holder 142 is located at the capping position at which each of the plurality of caps 141 covers the plurality of nozzles 10 of one of the plurality of head modules 11 corresponding thereto.

The ten caps 141 are connected to the switching device 143 via ten tubes 146*a*, respectively. Further, the switching device 143 is connected to the pump 144 via a tube 146*b*. Further, the switching device 143 selectively connects, to the pump 144, any one of the ten caps 141. The pump 141 is, for example, a tube pump, etc., and is connected to the waste liquid tank 145 via a tube 146*c*.

In order to perform the suction purge by the purge device 140, the cap holder 142 is moved to the capping position by the moving device. After locating the cap holder 142 at the capping position, then, the switching device 143 connects any one cap 141 among the ten caps 141 with the pump 144. Further, in this state, the pump 144 is driven. Then, any viscous ink inside the head module 11, etc., is jetted or discharged from the plurality of nozzles 10 covered by the one cap 141 connected to the pump 144. Furthermore, by switching a cap 141, among the ten caps 141, which is connected to the pump 144 in order by the switching device 143 and by driving the pump 144, the viscous ink, etc., is made to be jetted from each of the head modules 11 in order. Note that the jetted ink is stored in the waste liquid tank 145.

Note that when the suction purge is performed, the suction by the pump 141 causes the ink inside the liquid chamber 112 to flow into the liquid chamber 111 via the filter 63. Further, the ink flowed into the liquid chamber 111 flows into the inside of the head 21 via the outflow-connecting aperture 78 and the outflow apertures 52*b*1 and 52*c*1. Since the filter 63 is located in the inside of the filter chamber 74, it is also possible to prevent the foreign matter or substance, etc., in the ink from flowing into the head 21 even when such a flow of the ink is generated.

In the embodiment as explained above, the heat spreader 23 extends in the left-right direction over the two driver ICs 50, whereas the rigid substrate 25 and the heat spreader 23 are arranged side by side in the front-rear direction. Further, the thickness of the rigid substrate 25 is along the front-rear direction. Furthermore, in the embodiment, the rigid substrate 25 is arranged in front of the heat spreader 23, with a spacing distance from the heat spreader 23, due to which the rigid substrate 25 and the heat spreader 23 do not overlap with each other in the up-down direction. With this, it is possible to prevent the heat radiation by the heat spreader 23 from being hindered by the rigid substrate 25. Further, it is possible to prevent the size of the head module 11, from becoming large in the arrangement direction of the nozzles 10 in the head module 11 (the left-right direction), as compared with a case wherein the rigid substrate 25 and the heat spreader 23 are arranged side by side in the left-right direction.

Here, in view of equalizing the heat in the two driver ICs 50 arranged side by side in the left-right direction, it is preferred that the heat spreader 23 is a heat spreader which extends over the two driver ICs 50 and which is common to the two driver ICs 50. Further, in this case, the heat spreader 23 becomes inevitably large in the left-right direction. Therefore, it is significantly meaningful to suppress the enlargement of the size of the head module 11 in the left-right direction by arranging the rigid substrate 25 and the heat spreader 23 side by side in the front-rear direction, as in the embodiment.

Further, in the embodiment, since the rigid substrate 25 is supported by the head holder 32 within the projected area of the head holder 32 in the up-down direction, it is possible to prevent or restrain the size of the head module 11 from becoming large in the front-rear and left-right directions.

Further, in the embodiment, the inlets 52*a*1, 52*d*1 and the outflow apertures 52*b*1, 52*c*1 are arranged side by side with respect to the plurality of nozzles 10 in the left-right direction; and the inlets 52*a*1, 52*d*1 and the outflow apertures 52*b*1, 52*c*1 are arranged side by side with respect to the case 27 in the up-down direction. Further, the case 27 and the heat spreader 23 are arranged side by side in the left-right direction. Accordingly, in such a case that, unlike the embodiment, the rigid substrate 25 is arranged side by side in the left-right direction with respect to the case 27 and the heat spreader 23, the enlargement of the size of the head module 11 in the left-right direction becomes significant. In the present embodiment, the rigid substrate 25 and the heat spreader 23 are arranged side by side in the front-rear direction, with respect to the arrangement wherein the case 27 and the heat spreader 23 are arranged side by side in the left-right direction. Accordingly, it is possible to suppress the enlargement in the size of the head module 11 in the longitudinal direction of the head (the longitudinal direction of the nozzle surface).

Further, in the embodiment, the inflow port 71 and the outflow port 72 are positioned at the upper end portion of the case 27, and the connector 59 is positioned at the upper end portion of the rigid substrate 25. With this, in a case that the head module 11 is inserted into the accommodating section 12*a*, the operation for connecting the connector R1 to the inflow port 71, the operation for connecting the connector R2 to the outflow port 72, and the operation for connecting the connector 59 to the connector K can be easily performed.

Furthermore, in the embodiment, the case 27 and the substrate holder 26 which supports the rigid substrate 25 are fixed to the head holder 32. With this, the relative positional relationship of the inflow port 71 and the outflow port 72 of the case 27 with respect to the connector 59 of the rigid substrate 25 is maintained. Here, in the accommodating section 12*a*, it is preferred that the connector R1, the connector R2 and the connector K are arranged in the positional relationship such that the connector R1, the connector R2 and the connector K correspond to the inflow port 71, the outflow port 72 and the connector 59, respectively. In such a case, when the head module 11 is (being) inserted into the accommodating section 12*a*, the connection between the inflow port 71 and the connector R1, the connection between the outflow port 72 and the connector R2, and the connection of the connector 59 and the connector K can be performed at a time.

Further, in the embodiment, the case 27 has the filter chambers 73 and 74. With this, any foreign matter or substance in the ink, etc., is captured in the case 27, which in turn makes it possible to prevent any foreign matter or substance in the ink, etc., from flowing into the head 21.

Furthermore, in the embodiment, the cooler 28 is located on the upper surface of the heat spreader 23, thereby making it possible to release the heat, transferred from the driver ICs 50 to the heat spreader 23, to the outside via the cooling channel 130. In the embodiment, also regarding the above-described configuration, the case 27 has the heaters 116 and 128; the heats respectively from the heaters 116 and 128 not only heat the ink inside the case 27, but also are transferred to the right side relative to the case 27 (radiant heat from the heaters 116 and 128). Accordingly, in a region, of the head module 11, which is located on the right side relative to the case 27, the temperature tends to be higher at a left side portion (a portion which closer to the case 27 in the left-right direction) of this region. In view of this, in the embodiment, the first channel 131 on the upstream side, among the cooling channel 130, is located at a position closer to the left side, namely at a position closer to the heaters 116 and 128, than the second channel 132 on the downstream side. With this, the heat generated in the driver ICs 50 and the heats generated in the heaters 116 and 128 can be released to the outside efficiently.

Moreover, in the embodiment, since the cooler 28 is located on the upper surface of the heat spreader 23, a portion or part of the cooler 28 is located at a space surrounded by the case 27, the heat spreader 23 and the rigid substrate 25. Since this space is a dead space, it is possible to arrange each of the heat spreader 23, the case 27, the cooler 28 and the rigid substrate 25 within a limited range.

Further, in the embodiment, the cooling channel 130 is located at the same position as the centers of the heaters 116 and 128 in the front-rear direction. With this, it is possible to release the radiant heats, from the heaters 116 and 128 to the both sides in the front-rear direction, to the outside in an even or equalized manner.

Next, an explanation will be given about modifications obtained by adding a various kinds of changes to the embodiment of the present disclosure.

In the above-described embodiment, the cooler 28 has been explained as a portion of each of the head modules 11 which is detachably installable with respect to the printing apparatus 1. However, there is no limitation to this. For example, the cooler 28 may be provided on the printing apparatus 1; more specifically, the cooler 28 may be arranged in the inside of the accommodating section 12*a*. In such a case, at a point of time when the installment of the head modules 11 to the module holder 2 of the printing apparatus 1, the thermal connection of the cooler 28 with the heat spreader 23 is completed. In addition, at the point of time when the installment of each of the head modules 11 with respect to the printing apparatus 1 is completed, the cooler 28 is consequently located in a dead space surrounded by the heat spreader 23 and the rigid substrate 25. Accordingly, it is possible to arrange each of the heat spreader 23, the cooler 28 and the rigid substrate 25 within a limited range. Further, since this dead space is also surrounded by the case 27, it is possible to arrange each of the case 27, the heat spreader 23, the cooler 28 and the rigid substrate 25 within a limited range.

Further, in a process of installing the head modules 11 in the module holder 12, the following two connections are along the attaching/detaching direction. First connection of the two connections is the connection between the connector 59 and the connector K. The second connection of the two connections is the thermal connection between the cooler 28 and the heat spreader 23. Namely, by connecting the head modules 11 to the module holder 12 of the printing apparatus 1, these two connections can be realized at a time. In addition, as the third connection, any one or both of the connection between the inflow port 71 and the connector R1 and the connection between the outflow port 72 and the connector R is/are also along the attaching/detaching direction. Therefore, these three connections can be realized at a time.

Furthermore, the cooler 28 may be omitted. In such a case, the heat transferred from the driver ICs 50 to the heat spreader 23 is released directly to the outside. Namely, in this case, the heat spreader 23 functions as a heat sink.

In the embodiment, although the heat radiation grease G is positioned between the cooler 28 and the heat spreader 23, there is no limitation to this. The heat radiation grease G is not necessarily indispensable, provided that the cooler 28 and the heat spreader 23 are capable of making surface contact with each other. In reality, however, the cooler 28 and the heat spreader 23 make a point contact with each other at a plurality of locations, and the thermal conductivity is lowered by the air in a location at which the cooler 28 and the heat spreader 23 do not make the point contact with each other. Accordingly, in order not to lower the thermal conductivity, the heat radiation grease G is preferably intervened between the cooler 28 and the heat spreader 23.

In the embodiment, the two driver ICs 50 are elongated in the front-rear direction that is the short direction of the nozzle surface 31*a*, and the two driver ICs 50 are arranged side by side in the left-right direction that is the longitudinal direction of the nozzle surface 31*a*. However, there is no limitation to this. For example, the length (elongation) direction and the arrangement direction of the two driver ICs 50 may be different from those of the embodiment, for example, as such a configuration wherein the two drivers ICs 50 are elongated in the left-right direction, and are arranged side by side in the front-rear direction. Further, it is allowable that the number of the driver IC 50 is one, or three or more.

Furthermore, in the embodiment, the cooling channel 130 of the cooler 28 is located at the same position as the centers of the heaters 116 and 128 in the front-rear direction. However, there is no limitation to this. It is allowable that the cooling channel 130 is located at a position shifted to the front side or to the rear side relative to the position at which the cooling channel 130 is located in the embodiment.

Moreover, in the embodiment, the first channel 131 on the upstream side, among the cooling channel 130, is located at the position closer to the case 27 in the left-right direction, than the second channel 132, among the cooling channel 130, on the downstream side. However, there is no limitation to this. For example, in the left-right direction, the second portion 132 of the cooling channel 103 may be located at the position closer to the case 27 than the first portion 131 of the cooling channel 130. Alternatively, for example, it is allowable that the distance from the case 27 in the left-right direction is same regarding the first channel 131 and the second channel 132 of the cooling channel 130, for example as in such a case that the first channel 131 and the second channel 132 are arranged side by side in the front-rear direction.

Further, in the embodiment, although the case 27 has the filters 62 and 63 configured to capture any foreign matter or substance in the ink, etc., there is no limitation to this. The case 27 may be a case not provided with the filters 62 and 63. Note that in such a case, since the foreign matter in the ink, etc., is not captured in the case 27, it is preferred that the openings 37*a* to 37*d* are covered by the filters 38*a* to 38*d*, respectively, as described above.

Furthermore, in the embodiment, the substrate holder 26 supporting the rigid substrate 25 is fixed to the head holder 32, thereby allowing the rigid substrate 25 to be supported by the head holder 32. However, there is no limitation to this. For example, the rigid substrate 25 may be supported directly by the head holder 32.

Moreover, in the embodiment, the case 27 and the rigid substrate 25 are fixed to the head holder 32, thereby fixing the case 27 and the rigid substrate 25 to each other via the head holder 32. However, there is no limitation to this. For example, the case 27 and the rigid substrate 25 may be directly fixed to each other.

Further, in the embodiment, the inflow port 71 and the outflow port 72 are located at the upper end portion of the case 27, and the connector 59 is located at the upper end portion of the rigid substrate 25. However, there is no limitation to this. For example, the connector 59 may be located at a portion which is different from the upper end portion of the rigid substrate 25. Alternatively, at least one of the inflow port 71 and the outflow port 72 may be located at a portion which is different from the upper end portion of the case 27. In such a case, it is preferred that the position of the connector 59 and the positions of the inflow port 71 and the outflow port 72 are such positons in each of which a surface, in which one of the connector 59 and the positions of the inflow port 71 and the outflow port 72 is open, is orthogonal to the vertical direction that is the attaching/detaching direction of the head module 11.

Furthermore, in the embodiment, the case 27 and the heat spreader 23 are arranged side by side in the left-right direction. However, there is no limitation to this. For example, it is allowable that the position of the case 27 and the position of the heat spreader 23 are shifted in the front-rear direction, and that the case 27 and the rigid substrate 25 are not arranged side by side in the left-right direction.

Moreover, in the embodiment, the head module 11 is configured to have the case 27 which is arranged on the upper surface of the head 21 (head holder 32). However, there is no limitation to this. For example, it is allowable that the head module 11 does not have the case 27, and that tubes, etc., connected to the ink tank T are directly connected to the inlets 52*a*1, 52*d*1 and the outflow apertures 52*b*2, 52*c*2.

Further, in the embodiment, the rigid substrate 25 is located at the position on the front side relative to the heat spreader 23 and with a spacing distance from the heat spreader 23, to thereby arrange the rigid substrate 25 so as not to overlap with the heat spreader 23 in the vertical direction. However, there is no limitation to this. For example, it is allowable to allow the rigid substrate 25 to overlap with a front end portion of the heat spreader 23 in the up-down direction. In such a case, the rigid substrate 25 and a rear portion, of the heat spreader 23, which is located on the rear side relative to the front portion of the heat spreader 23 (a portion of the heat spreader 23) are consequently arranged side by side in the front-rear direction. In this case also, since the thickness direction of the rigid substrate 25 is along the front-rear direction, it is possible to make the overlapping of the heat spreader 23 with the rigid substrate 25 in the vertical direction to be small, which in turn prevents the heat radiation from the heat spreader 23 from being inhibited (hindered) by the rigid substrate 25.

Furthermore, in the embodiment, the rigid substrate 25 is positioned within the projected plane of the head 21 (head holder 32) in the up-down direction, and does not protrude from (beyond) the head holder 21 in any of the front-rear direction and the left-right direction. However, there is no limitation to this. For example, it is allowable that a portion of the rigid substrate 25 protrudes from the head 21 in the left-right direction or in the front-rear direction.

Moreover, it is allowable that the head 21, the driver ICs 50 (COF substrate 22), the heat spreader 23, the rigid substrate 25, the substrate holder 26, the case 27, etc. have the positional relationship with respect to one another as described above. Further, each of the driver ICs 50 (COF substrate 22), the heat spreader 23, the rigid substrate 25, the substrate holder 26, the case 27, etc. may have a configuration different from that as described above, under a condition that the driver ICs 50 (COF substrate 22), the heat spreader 23, the rigid substrate 25, the substrate holder 26, the case 27, etc. have the above-described positional relationship with respect to one another. For example, the head module may be configured such that the ink is not circulated between the head module 21 and the ink tank T; and that head 21 does not have the outflow apertures 52*b*1 and 52*c*2. Further, in this case, it is allowable that the case 27 does not have the outflow port 72, the filter chamber 74, the outflow-connecting aperture 78, etc.

Figure 18:
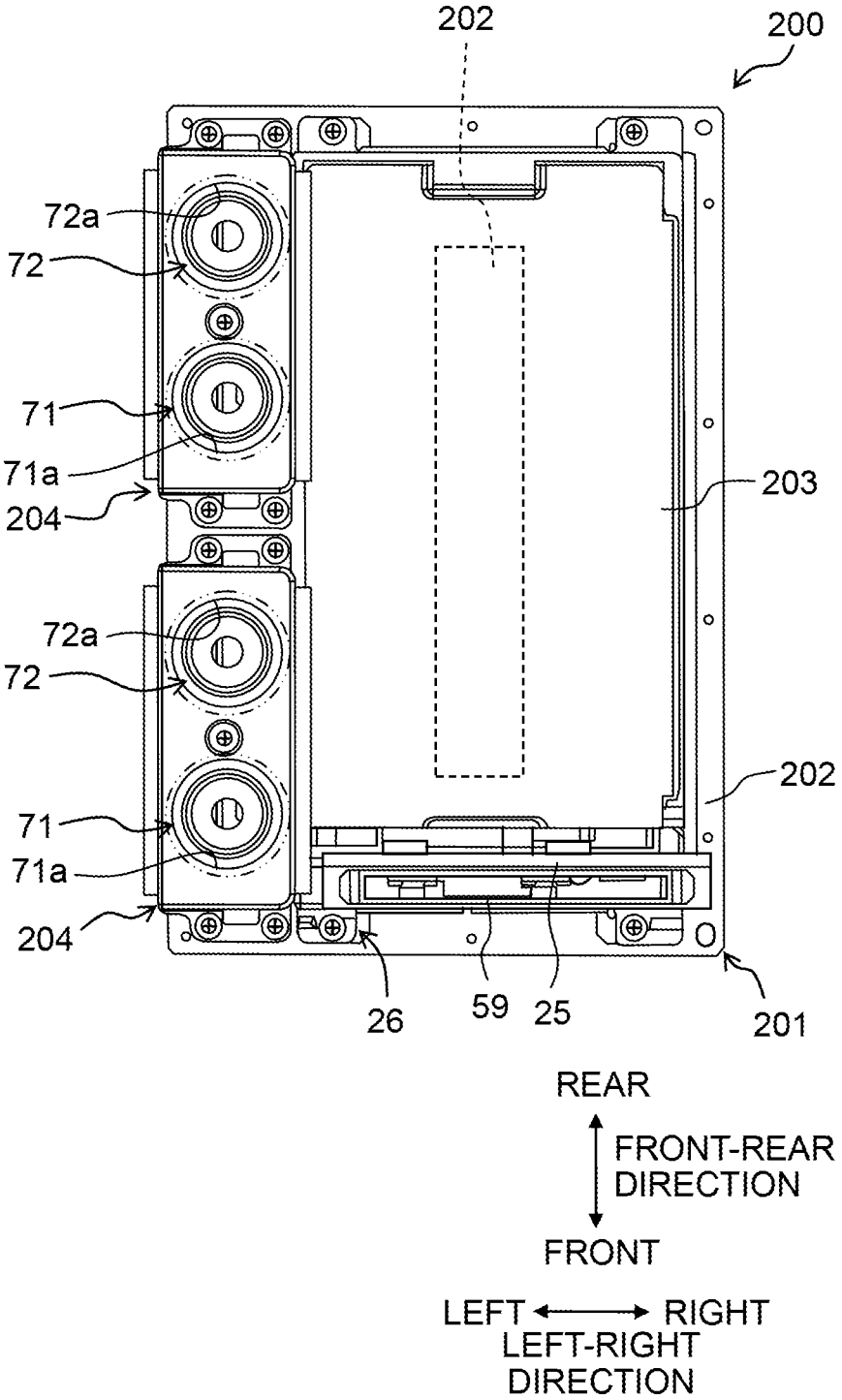
FIG. 18 is a view of a modification corresponding to FIG. 6B.
Figure 19:
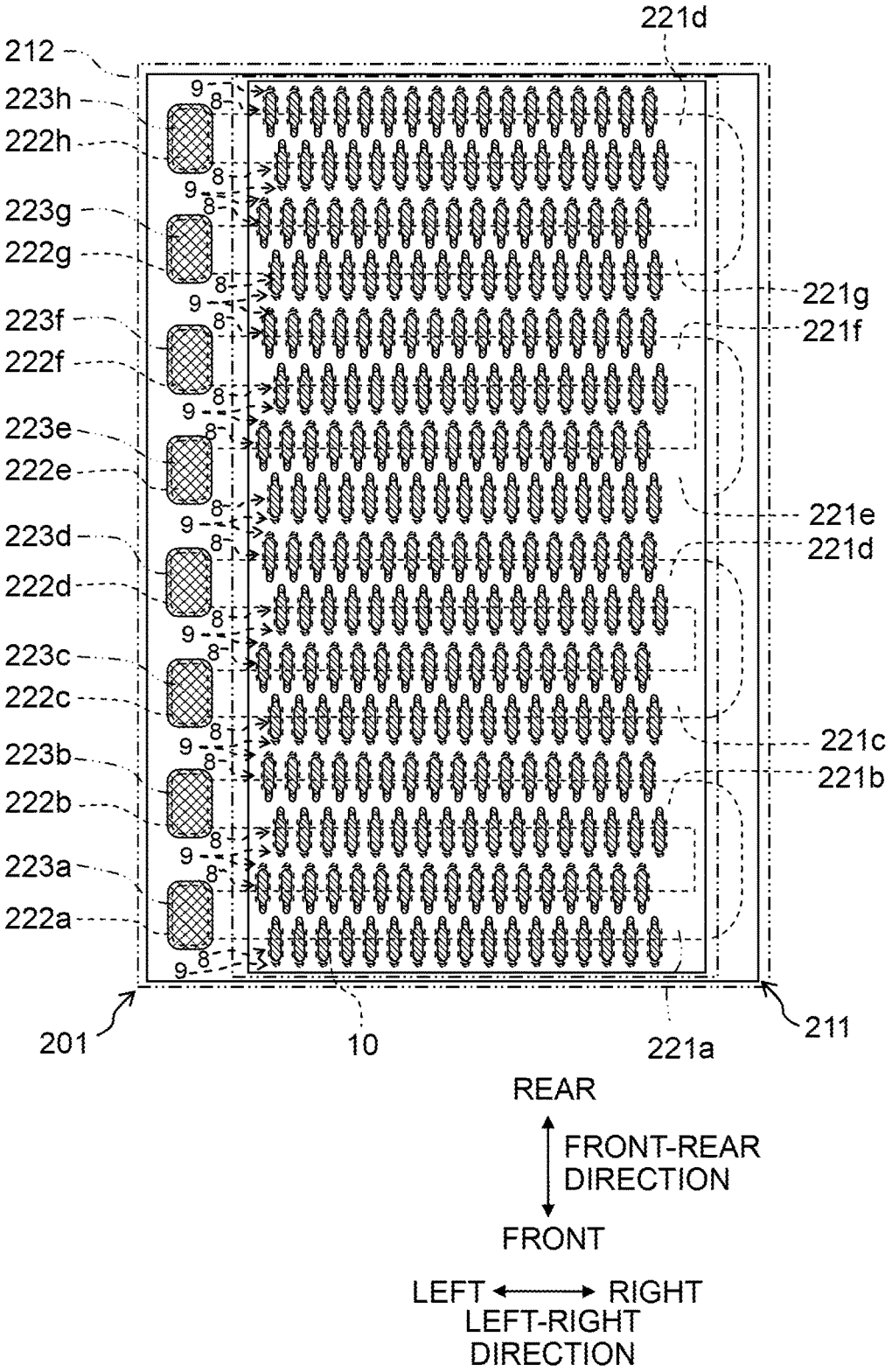
FIG. 19 is a view of the modification of the configuration depicted in FIG. 8.

Furthermore, in the embodiment, the front-rear direction in which the rigid substrate 25 and the heat spreader 23 are arranged side by side to each other is the short direction of the nozzle surface 31*a*. However, there is no limitation to this. For example, in a modification as depicted in FIG. 18, a head module 200 is provided with a head 201. The head 201 has sixteen pieces of the nozzle row 9 which are arranged side by side in the front-rear direction, as depicted in FIG. 19; the number of the nozzle row 9 is twice the number of the nozzle row 9 in the head 21. Further, corresponding to this, eight manifold channels 221*a* to 221*h* are arranged side by side in the front-rear direction. Furthermore, eight openings 222*a* to 222*h* corresponding to the eight manifold channels 221*a* to 221*h*, respectively, are arranged side by side in the front-rear direction, on the upper surface of a left end portion of the head 201 (head chip 211). With this, the head 201 is configured to have a length in the front-rear direction (an example of the "first direction") which is longer than that of the head 21. Moreover, the front-rear direction orthogonal to the alignment direction of the nozzles 10 is the longitudinal direction of the head 201, and the left-right direction as the alignment direction of the nozzles 10 (example of the "second direction") is the short direction of the head 201. Further, four inlets 223*a*, 223*d*, 223*e* and 223*h* corresponding to the four openings 222*a*, 222*d*, 222*e* and 222*h*, respectively, and four outflow apertures 223*b*, 223*c*, 223*f* and 223*g* corresponding to the four openings 222*b*, 222*c*, 222*f* and 222*g*, respectively, are open on the upper surface of the head holder 212.

Furthermore, corresponding to this, a heat spreader 203 has a length in the left-right direction which is shorter than a length in the front-rear direction, as depicted in FIG. 18. Moreover, in the modification, only one piece of a driver IC 201 is connected with respect to the head 201, as depicted in FIG. 18. Further, two cases 204 arranged side by side in the front-rear direction are located on the upper surface of a left end portion of the head holder 212. Each of the cases 204 is similar to the case 27 (see FIG. 3) of the above-described embodiment, and an inflow port 71 and an outflow port 72 of each of the cases 204 are connected to the ink tank T (see FIG. 2) via non-illustrated tubes, respectively. Note that it is allowable that the head module 200 has one piece of a case which extends in the front-rear direction over the entire length of the head 201, and has portions corresponding to the two cases 204, respectively.

Furthermore, the ink supplied from the ink tank T (see FIG. 2) and flowed into the inflow port 71 of a case 204 which is included in the two cases 204 and which is located on the front side flows into the head 201 from the two inlets 223*a* and 223*d*. Moreover, the ink outflowed form the two outflow apertures 223*b* and 223*c* flows out of the outflow port 72 of the case 204 located on the front side and toward the ink tank T. Further, the ink supplied from the ink tank T (see FIG. 2) and flowed into the inflow port 71 of a case 204 which is included in the two cases 204 and which is located on the rear side flows into the head 201 from the two inlets 223*e* and 223*h*. Moreover, the ink outflowed form the two outflow apertures 223*f* and 223*g* flows out of the outflow port 72 of the case 204 located on the rear side and toward the ink tank T.

Also in the modification, the heat spreader 203 and the rigid substrate 25 are arranged side by side in the front-rear direction. Accordingly, it is possible to suppress any enlargement in size of the head module 200 in the left-right direction as the nozzle alignment direction of the nozzle 10 (see FIG. 8), than in a case that the heat spreader 203 and the rigid substrate 25 are arranged side by side in the left-right direction. Note that in this modification, although the head module 200 is provided with only one piece of the driver IC 202, it is allowable that the head module 200 is provided with two pieces of the driver IC 202 in a similar manner with the head module 11, or that the head module 202 is provided with three or more pieces of the driver IC 202.

Further, in the above-described embodiment, although the case 27 is fixed to the head 21 via the sealing material 55, there is no limitation to this. For example, it is allowable that the case 27 is fixed to the head 21 via a first sealing member, another channel structure, and a second sealing member. In such a case, the first sealing member is positioned between the case 27 and the another channel structure, and the second sealing member is positioned between the another channel structure and the head 21. The first sealing member and the second sealing member are each a so-called packing formed of a rubber material, similarly to the sealing member 55. In this case, the another channel structure is provided with two inflow channels each having an end which is communicated with one of the two inflow-connecting apertures 77*a* and 77*b* of the case 27, and one outflow channel having one end which is communicated with the outflow-connecting aperture 78 of the case 27. The other end of each of the two inflow channels is connected to one of the outflow ports 52*a*1 and 52*d*1, and the other end of the one outflow channel is connected to the outflow ports 52*b*1 and 52*c*1. Further, the first sealing member makes contact with the case 27, makes contact with the another channel structure, and makes contact, for example, with the upper surface of the another channel structure. The second sealing member makes contact with the another channel structure, makes contact, for example, with the lower surface of the another channel structure, and makes contact with the head 21. Note that it is allowable that the second sealing member is adhered to the head 21, for example, via a silicone-based adhesive which is interposed between the second sealing member and the head 21.

Further, in this case, the heat spreader 23 is located at a position below the another channel structure in the vertical direction. Accordingly, for example, an opening via which the heat spreader 23 is exposed is formed in the another channel structure, and the heat spreader 23 which is exposed via the opening is allowed to make contact with the cooler 28. Further, in this case, the lower surface of the another channel structure makes contact with the upper surface of the head holder 32. Furthermore, the rigid substrate 25 and the case 27 are located on the upper surface of the another channel structure.

Moreover, in the embodiment, the printing apparatus 1 is provided with the line head 4 having the plurality of head modules 11. However, there is no limitation to this. For example, the printing apparatus may be a so-called serial type printing apparatus in which a carriage which is movable in the left-right direction has a head module 11 mounted thereon.

Further, in the description above, the explanation has been given about the example in which the present disclosure is applied to the printing apparatus configured to perform printing by jetting the inks from the nozzles. However, the example to which the present disclosure is applicable is not limited to this. For example, the present disclosure is also applicable to a printing apparatus configured to perform printing by jetting a liquid different from the ink(s), such as a material of a wiring pattern to be printed on a wiring board (liquid for a pattern material). Further, the present disclosure is also applicable to a liquid jetting apparatus which is different from the printing apparatus.

What is claimed is:

1. A head module configured to be removably attached to a liquid jetting apparatus along an attaching direction, comprising:

a head having:

an inlet;

a plurality of nozzles configured to jet a liquid inflowed thereto via the inlet; and a plurality of driving elements configured to impart a jetting energy to the liquid in the plurality of nozzles, respectively, the plurality of nozzles being aligned in a row in a longitudinal direction of a nozzle surface which is orthogonal to the attaching direction;

at least one driver IC configured to drive the plurality of driving elements;

a heat spreader thermally making contact with the at least one driver IC;

a flexible substrate connected to the at least one driver IC; and a rigid substrate connected to the flexible substrate and having rigidity higher than that of the flexible substrate, wherein in the attaching direction, the at least one driver IC is arranged between the head and the heat spreader;

the rigid substrate and the head are arranged side by side in the attaching direction;

the rigid substrate and the heat spreader are arranged side by side in the longitudinal direction; and the rigid substrate has a thickness along the longitudinal direction.

2. The head module according to claim 1, wherein the heat spreader extends over the at least one driver IC.

3. The head module according to claim 1, wherein the rigid substrate is supported by the head within a projection plane of the head in the attaching direction.

4. The head module according to claim 1, wherein the rigid substrate and the heat spreader are arranged such that the rigid substrate and the heat spreader do not overlap with each other in the attaching direction.

5. The head module according to claim 4, wherein the rigid substrate is arranged such that the rigid substrate is positioned with a spacing distance from the heat spreader in the longitudinal direction of the nozzle surface.

6. The head module according to claim 1, wherein the at least one driver IC includes two driver ICs.

7. The head module according to claim 6, wherein the two driver ICs are arranged in the longitudinal direction.

8. A liquid jetting apparatus comprising:

a plurality of head modules, each of which is defined in claim 1;

a module holder holding the plurality of the head modules, wherein the module holder holds the plurality of the head modules in a state that the plurality of the head modules are arranged side by side along the longitudinal direction of the nozzle surface.

9. A head module configured to be removably attached to a liquid jetting apparatus along an attaching direction, comprising:

a head having;

an inlet;

a plurality of nozzles configured to jet a liquid inflowed thereto via the inlet; and a plurality of driving elements configured to impart a jetting energy to the liquid in the plurality of nozzles, respectively, the plurality of nozzles being aligned in a row in a first direction parallel to a nozzle surface which is orthogonal to the attaching direction;

a driver IC configured to drive the plurality of driving elements;

a heat spreader thermally making contact with the driver IC;

a flexible substrate connected to the driver IC; and a rigid substrate connected to the flexible substrate and having rigidity higher than that of the flexible substrate, wherein in the attaching direction, the driver IC is arranged between the head and the heat spreader;

the rigid substrate and the head are arranged side by side in the attaching direction;

the rigid substrate and the heat spreader are arranged side by side in the first direction; and the rigid substrate has a thickness along the first direction.

10. A head module comprising:

a head chip having:

nozzles aligned in a row in a first direction crossing a second direction, the nozzles being extending along a third direction which is perpendicular to the first and second directions; and driving elements positioned to respectively impart a jetting energy to the liquid in the nozzles;

a head holder supporting the head chip and having an inlet communicated with the nozzles;

a driver IC connected to the driving elements and configured to drive the driving elements;

a heat spreader thermally making contact with the driver IC;

a flexible substrate connected to the driver IC;

a rigid substrate connected to the flexible substrate and having rigidity higher than that of the flexible substrate; and a connector positioned on one end of the rigid substrate in the third direction;

wherein:

the driver IC is positioned between the head chip and the heat spreader in the third direction;

the other end of the rigid substrate in the third direction is supported by the head holder within a projection plane of the head holder in the third direction;

the rigid substrate and the heat spreader are arranged side by side in the first direction;

the rigid substrate has a thickness along the first direction; and one end of the connector in the third direction is further from the head holder than the one end of the rigid substrate in the third direction.

* * * * *